US012352528B2

(12) United States Patent
Roberts et al.

(10) Patent No.: US 12,352,528 B2
(45) Date of Patent: Jul. 8, 2025

(54) CLAMP MOUNT SYSTEM FOR A FIREARM ARM BRACE

(71) Applicant: Magpul Industries Corp., Austin, TX (US)

(72) Inventors: Timothy Eric Roberts, Broomfield, CO (US); Cristopher McRae, Austin, TX (US); Duane Liptak, Austin, TX (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/082,876

(22) Filed: Dec. 16, 2022

(65) Prior Publication Data

US 2023/0194203 A1 Jun. 22, 2023

Related U.S. Application Data

(60) Provisional application No. 63/290,424, filed on Dec. 16, 2021.

(51) Int. Cl.

| | |
|---|---|
| ***F41C 23/12*** | (2006.01) |
| ***F41C 23/02*** | (2006.01) |
| ***F41C 23/20*** | (2006.01) |

(52) U.S. Cl.

CPC ..... *F41C 23/12* (2013.01); *F41C 23/02* (2013.01); *F41C 23/20* (2013.01)

(58) Field of Classification Search

CPC ..... F41A 23/00; F41A 23/12; F41A 23/20

See application file for complete search history.

(56) References Cited

U.S. PATENT DOCUMENTS

| | | | | |
|---|---|---|---|---|
| 6,637,141 | B1 * | 10/2003 | Weatherby | F41C 23/06 42/75.03 |
| 7,398,616 | B1 * | 7/2008 | Weir | F41C 23/20 42/72 |
| 8,191,299 | B2 | 6/2012 | Faifer | |
| 8,756,849 | B2 | 6/2014 | Troy | |
| 8,782,941 | B2 | 7/2014 | Zusman | |
| 8,869,444 | B2 | 10/2014 | Bosco | |
| 9,109,855 | B1 | 8/2015 | Kincel | |
| 9,354,021 | B2 | 5/2016 | Bosco | |
| D774,618 | S | 12/2016 | Bosco et al. | |

(Continued)

OTHER PUBLICATIONS

Strike. <https://web.archive.org/web/20201112020246/https://www.strikeindustries.com/si-stab-arp.html>. Nov. 12, 2020. (Year: 2020).*

(Continued)

*Primary Examiner* — Gabriel J. Klein

(74) *Attorney, Agent, or Firm* — NOD Law PC

(57) ABSTRACT

A device may include an elongated body comprising an opening configured to receive a receiver extension tube of a firearm. A device may include a brace body affixed distally to the elongated body and comprising a window configured to receive a clamp mount, wherein the clamp mount is configured to retain the arm brace in a fixed position on the receiver extension tube and comprises: one or more clamps comprising at least one through-hole and one or more pads, wherein the one or more pads are configured to engage with the receiver extension tube via adjustment of one or more fasteners interfacing with the at least one though-hole.

19 Claims, 37 Drawing Sheets

(56) References Cited

U.S. PATENT DOCUMENTS

| | | | | |
|---|---|---|---|---|
| 9,551,549 | B1 * | 1/2017 | Chvala | F41C 7/00 |
| 9,574,846 | B2 | 2/2017 | Huang et al. | |
| 9,581,411 | B2 | 2/2017 | Zusman | |
| 9,746,282 | B1 * | 8/2017 | Huang | F41C 23/20 |
| D818,074 | S | 5/2018 | Ding et al. | |
| 10,012,470 | B2 | 7/2018 | Johnson | |
| 10,088,268 | B2 | 10/2018 | Hewes et al. | |
| 10,451,380 | B2 | 10/2019 | Vanek et al. | |
| D872,215 | S | 1/2020 | Overstreet et al. | |
| 10,545,006 | B1 * | 1/2020 | Zhang | F41C 23/12 |
| 10,551,144 | B2 | 2/2020 | Overstreet et al. | |
| 10,571,219 | B2 | 2/2020 | Wilson et al. | |
| D882,014 | S | 4/2020 | Jen | |
| 10,627,189 | B2 | 4/2020 | Faifer | |
| D888,867 | S * | 6/2020 | Jen | D22/108 |
| 10,823,528 | B2 | 11/2020 | Reavis, III | |
| 10,989,236 | B2 | 4/2021 | Cross | |
| 11,067,361 | B2 | 7/2021 | Keller et al. | |
| 2010/0115817 | A1 * | 5/2010 | Faifer | F41C 23/04 42/71.01 |
| 2014/0123528 | A1 | 5/2014 | Vesligaj | |
| 2014/0144061 | A1 * | 5/2014 | Bosco | F41C 23/10 42/94 |
| 2015/0176944 | A1 * | 6/2015 | Kupanoff | F41C 23/12 42/73 |
| 2016/0327361 | A1 * | 11/2016 | Roberts | F41C 23/14 |
| 2019/0063869 | A1 | 2/2019 | Keller et al. | |
| 2021/0172703 | A1 * | 6/2021 | Tippmann, Jr. | F41C 23/20 |
| 2021/0239423 | A1 * | 8/2021 | Liptak | F41C 23/12 |
| 2021/0372731 | A1 * | 12/2021 | Shinkle | F41C 23/14 |
| 2024/0068769 | A1 * | 2/2024 | Reavis, III | F41C 27/22 |

OTHER PUBLICATIONS

"AR15", Kak, "Retrieved from https://www.kakindustry.com/kak-shockwave-2-0-blade-and-tube-fde", Known to exist as early as Mar. 16, 2023, 3 page.

"BSL Arm Brace—Mil-Spec", Magpul, "Retrieved from https://magpul.com/bsl-arm-brace-mil-spec.html", Known to exist as early as Mar. 16, 2023, 3 pages.

"BTR Arm Brace—Mil-Spec", Magpul, "Retrieved from https://magpul.com/btr-arm-brace-mil-spec.html", Known to exist as early as Mar. 16, 2023, 3 pages.

"Cheek Rest Kits", Thordsen Customs, "Retrieved from https://www.thordsencustoms.com/ar-pistol/cheek-rest-kits.html", Known to exist as early as Mar. 16, 2023, 1 page.

"Factoring Criteria for Firearms with Attached "Stabilizing Braces"", Notice of Proposed Rulemaking, Docket No. ATF 2021R-08; AG Order No. 5070-2021, Jun. 7, 2021, "Retrieved from https://www.atf.gov/rules-and-regulations/docs/undefined/atf-2021r-08-notice-proposed-rulemaking-factoring-criteria/download", Known to exist as early as Mar. 16, 2023, 71 pages.

"Flux Defense", "Retrieved from https://www.fluxdefense.com/", Known to exist as early as Mar. 16, 2023, 1 page.

"MP5K Tailhook Mounting Arm", Gear Head Works, "Retrieved from https://gearheadworks.com/product/mp5k-tailhook-mounting-arm/", Known to exist as early as Mar. 16, 2023, 1 page.

"Pistol Storage Device (PSD) Not a Stabilizing Brace", Pistol Mounted Solutions, "Retrieved from https://pistolmountedsolutions.com/", Known to exist as early as Mar. 16, 2023, 2 page.

"SB Tactical", "Retrieved from https://www.sb-tactical.com/", Known to exist as early as Mar. 16, 2023, 2 pages.

"Shockwave Blade Pistol Stabilizer—Black", Kak, "Retrieved from https://www.kakindustry.com/shockwave/shockwave-black", Known to exist as early as Mar. 16, 2023, 1 page.

"Sig Sauer", Retrieved from https://www.sigsauer.com/store/sig-sauer-folding-pcb-kit-mpx-mcx-black, Known to exist as early as Mar. 16, 2023, 2 page.

"Strongarm Pistol Brace", Doublestar, "Retrieved from https://doublestarusa.com/strongarm-pistol-brace-dsc102.html", Known to exist as early as Mar. 24, 2023, 1 page.

"Tailhook MOD 1 Features", Gear Head Works, "Retrieved from https://gearheadworks.com/tailhook/", Known to exist as early as Mar. 16, 2023, 2 pages.

"Tailhook MOD 2 Features", Gear Head Works, "Retrieved from https://gearheadworks.com/tailhook/", Known to exist as early as Mar. 16, 2023, 2 pages.

* cited by examiner

CLAMP MOUNT SYSTEM FOR A FIREARM ARM BRACE

CLAIM OF PRIORITY UNDER 35 U.S.C. § 119

The present Application for Patent claims priority to Provisional Application No. 63/290,424 entitled "CLAMP MOUNT SYSTEM FOR FIREARM ARM BRACE" filed Dec. 16, 2021, and assigned to the assignee hereof and hereby expressly incorporated by reference.

FIELD OF THE DISCLOSURE

The present disclosure relates generally to firearms. In particular, but not by way of limitation, the present disclosure relates to systems, methods and apparatuses for a clamp mount system for a firearm arm brace or stock.

DESCRIPTION OF RELATED ART

Firearms classified as Title I under the National Firearms Act (NFA) have significantly reduced costs and processes involved with acquiring, storing, using, and/or transporting, as compared with Title II firearms (e.g., short-barreled rifles or SBRs, machine guns, short-barreled shotguns, silencers, etc.). Consequently, pistol braces have become popular on many platforms, including AR-15 type guns, to provide for a handy firearm without the additional hassle of dealing with the NFA process. To regulate this market, the Alcohol, Tobacco, and Firearms (ATF) agency recently released a proposed rule to define what constitutes a Title I pistol versus a Title II SBR. According to this rule, the firearm being evaluated cannot exceed a threshold score (e.g., 4) in each section before it is deemed to be an SBR. Currently there are two sections under which a firearm is evaluated, but this is subject to change. Based on this updated guidance from the ATF, many currently used firearm braces mounted onto AR-platform pistols may have a difficult (if not impossible) time remaining compliant. Hence, there is a need for a refined arm brace that can proactively comply with ATF's new guidance.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

In some aspects, the techniques described herein relate to an arm brace, including: an elongated body including an opening configured to receive a receiver extension tube of a firearm; and a brace body affixed distally to the elongated body and including a window configured to receive a clamp mount, wherein the clamp mount is configured to retain the arm brace in a fixed position on the receiver extension tube and includes: one or more clamps including at least one through-hole and one or more pads, wherein the one or more pads are configured to engage with the receiver extension tube via adjustment of one or more fasteners interfacing with the at least one though-hole.

In some aspects, the techniques described herein relate to an arm brace, wherein the brace body further includes a blade extending distally relative to the elongated body.

In some aspects, the techniques described herein relate to an arm brace, wherein the brace body further includes a sling mount positioned proximally relative to an end of the brace body and configured to engage with at least one of a Quick Detach (QD) sling swivel and a QD socket.

In some aspects, the techniques described herein relate to an arm brace, wherein the window further includes one or more protrusions configured to extend outward relative to the elongated body and shaped and sized to seat the one or more fasteners of the clamp mount.

In some aspects, the techniques described herein relate to an arm brace, wherein the clamp mount further includes at least one boss configured to engage with an inner bottom portion of the window and interface with the one or more protrusions.

In some aspects, the techniques described herein relate to an arm brace, wherein the clamp mount is a pistol clamp mount and is configured to engage with a cylindrical profile of a pistol receiver extension tube.

In some aspects, the techniques described herein relate to an arm brace, wherein the clamp mount is a keyed clamp mount and is configured to engage with a keyed profile of a keyed receiver extension tube.

In some aspects, the techniques described herein relate to an arm brace, wherein the clamp mount further includes at least one insert shaped and sized to fit into a tube positioning hole of the receiver extension tube, wherein the at least one insert includes: a vertical section shaped and positioned near one end of a longitudinal section of the at least one insert, wherein the vertical section is configured to be received within a tube locking hole of the keyed profile of the keyed receiver extension tube; and one or more channels positioned on a horizontal section and configured to receive the one or more fasteners and align with the at least one through-hole of the one or more clamps.

In some aspects, the techniques described herein relate to an arm brace, wherein the one or more fasteners are male screws and female screws, the female screws including a threaded hollow post extending between the one or more clamps and configured to receive at least a portion of the male screws.

In some aspects, the techniques described herein relate to an arm brace, wherein the one or more clamps further includes at least one recess configured to receive the one or more pads, wherein each recess of the at least one recess includes a plurality of serrations configured to engage a bottom surface of the one or more pads.

In some aspects, the techniques described herein relate to a mounting system, the system including: an arm brace, including: an elongated body including an opening configured to receive a receiver extension tube of a firearm; and a brace body affixed distally to the elongated body and including a window configured to receive a clamp mount, wherein the clamp mount is configured to retain the arm brace in a fixed position on the receiver extension tube and includes: one or more clamps including at least one through-hole and one or more pads, wherein the one or more pads are configured to engage with the receiver extension tube via adjustment of one or more fasteners interfacing with the at least one though-hole.

In some aspects, the techniques described herein relate to a mounting system, wherein the brace body further includes a blade extending distally relative to the elongated body.

In some aspects, the techniques described herein relate to a mounting system, wherein the brace body further includes a sling mount positioned proximally relative to an end of the brace body and configured to engage with at least one of a Quick Detach (QD) sling swivel and a QD socket.

In some aspects, the techniques described herein relate to a mounting system, wherein the window further includes one or more protrusions configured to extend outward relative to the elongated body and shaped and sized to seat the one or more fasteners of the clamp mount.

In some aspects, the techniques described herein relate to a mounting system, wherein the clamp mount further includes at least one boss configured to engage with an inner bottom portion of the window and interface with the one or more protrusions.

In some aspects, the techniques described herein relate to a mounting system, wherein the clamp mount is a pistol clamp mount and is configured to engage with a cylindrical profile of a pistol receiver extension tube.

In some aspects, the techniques described herein relate to a mounting system, wherein the clamp mount is a keyed clamp mount and is configured to engage with a keyed profile of a keyed receiver extension tube.

In some aspects, the techniques described herein relate to a mounting system, wherein the clamp mount further includes at least one insert shaped and sized to fit into a tube positioning hole of the receiver extension tube, wherein the at least one insert includes: a vertical section shaped and positioned near one end of a longitudinal section of the at least one insert, wherein the vertical section is configured to be received within a tube locking hole of the keyed profile of the keyed receiver extension tube; and one or more channels positioned on a horizontal section and configured to receive the one or more fasteners and align with the at least one through-hole of the one or more clamps.

In some aspects, the techniques described herein relate to a mounting system, wherein the one or more fasteners are male screws and female screws, the female screws including a threaded hollow post extending between the one or more clamps and configured to receive at least a portion of the male screws.

In some aspects, the techniques described herein relate to a mounting system, wherein the one or more clamps further includes at least one recess configured to receive the one or more pads, wherein each recess of the at least one recess includes a plurality of serrations configured to engage a bottom surface of the one or more pads.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
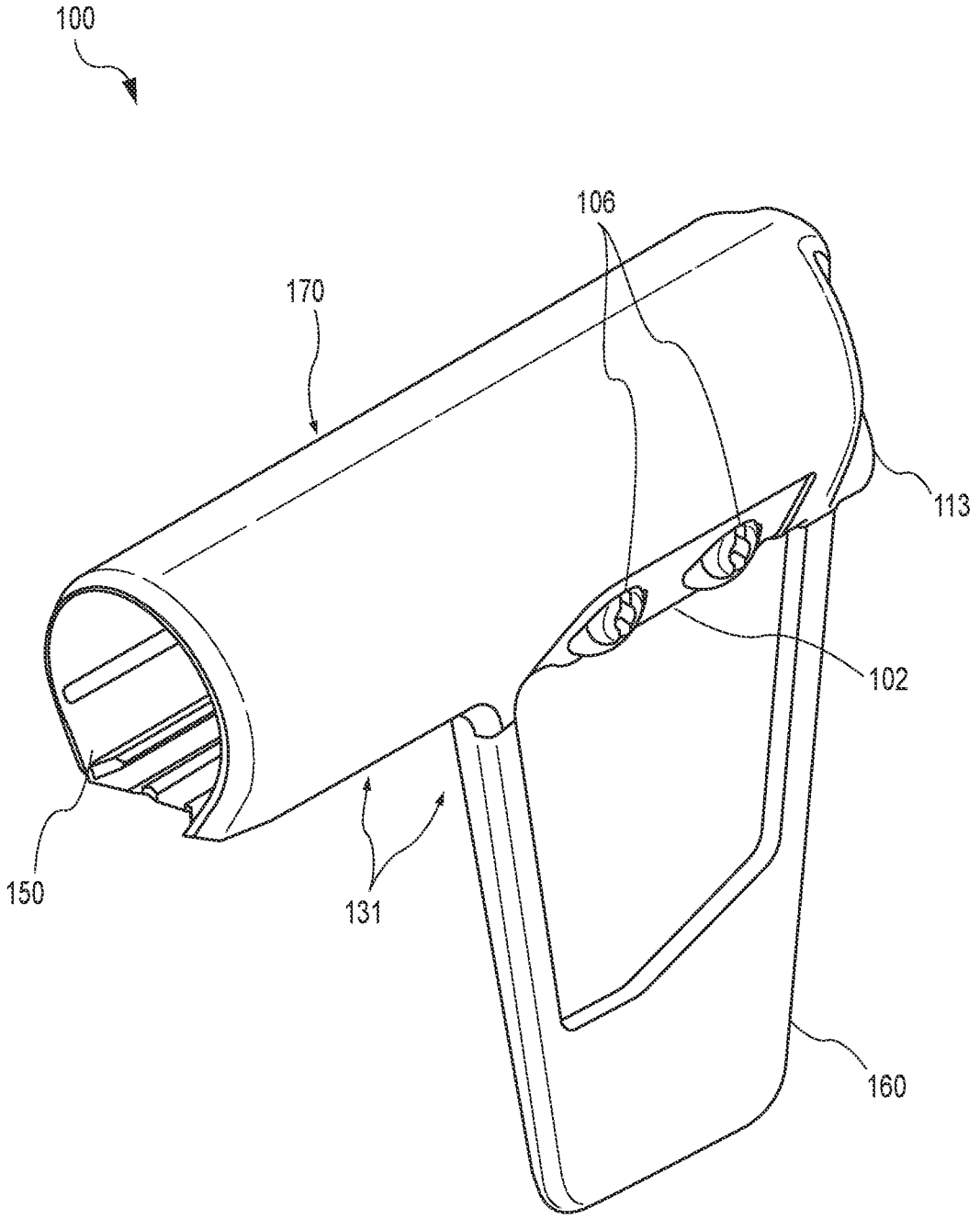
FIG. 1 illustrates a top perspective view of an arm brace according to an embodiment of the disclosure.

The present disclosure relates generally to a firearms. More specifically, but without limitation, the present disclosure relates to systems, methods and apparatuses for a clamp mount system for a firearm arm brace or stock.

The word "exemplary" is used herein to mean "serving as an example, instance, or illustration." Any embodiment described herein as "exemplary" is not necessarily to be construed as preferred or advantageous over other embodiments.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer, or section discussed below could be termed a second element, component, region, layer, or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items, and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

As used herein, the terms "distal" and "front" shall refer to a side or direction associated with a direction of intended fire; for example, in FIG. 1, the front or distal side is towards the left. Further, when referencing a side or direction associated with a direction of intended fire, the terms "back", "rear", or "proximal" shall be associated with the intended bracing of a weapon. When referencing a vertical direction, the term "distal" shall refer to a lower or bottom side of an object, for example, the side closer to the ground or floor. For instance, in FIG. 1, the distal side of the arm brace is towards the bottom of the page. Additionally, when referencing a vertical direction, the term "proximal" shall refer to an upper or top side of an object, for example, the side away from the ground or floor. For example, in FIG. 1, the proximal side of the arm brace is towards the top of the page.

Aspects of this disclosure generally relate to a clamp mount system for fitment of an arm brace or a stock to a receiver extension (e.g., round or keyed receiver extension). In some examples, the arm brace or stock includes a universal "fin type" brace body adapted to fit on both round receiver extension tubes (e.g., "pistol" type extension tubes) and keyed tubes, such as those adhering to the military specification ("Mil-Spec") cross-sectional profile. In some cases, the "fin type" brace body may include a single rigid blade extending in a distal (e.g., downward) direction from the longitudinal axis of the arm brace or firearm. In some embodiments the blade may rotate about a center axis of the brace body. In other instances the blade may be retractable. In some cases, different sets of clamps and screws may be provided for different types of receiver extension tubes, which may enable the brace body to be retained in a fixed, non-adjustable position relative to the extension tube, further described in relation to the FIGs. below.

FIG. 1 illustrates an example of an arm brace 100, according to various aspects of the disclosure. As seen, the arm brace 100 includes an arm brace body 131, the arm brace body 131 comprising an elongated body 170 having an opening 150 (also referred to as cavity, tunnel, or channel) at the distal end that is shaped and sized to receive a receiver extension tube of a firearm. The longitudinal axis of the opening 150 is parallel or substantially parallel to the longitudinal axis through the firearm. The arm brace body 131 further comprises a blade 160 extending in a downward (or distal) direction from the elongated body 170. In some examples, the arm brace 100 may be formed as a monolithic rigid piece using a material such as a polymer, a hard plastic, metal, carbon fiber, or any other applicable material. In such cases, the elongated body 170 and the blade 160 may be unitary in construction. In other cases, the elongated body 170 and the blade 160 may formed as separate pieces (e.g., using the same or different materials) and the blade 160 may be affixed to the underside or bottom of the elongated body 170 using fasteners (e.g., screws, set screws), clips, or any other applicable means. The arm brace 100 further comprises a window (e.g., shown as window 171 in FIG. 3) on each side (e.g., left side, right side with respect to the firing direction) of the elongated body 170, where each window may be shaped and sized to receive a clamp (e.g., shown as clamp 405 in FIG. 6) of a clamp mount system 102.

Figure 2:
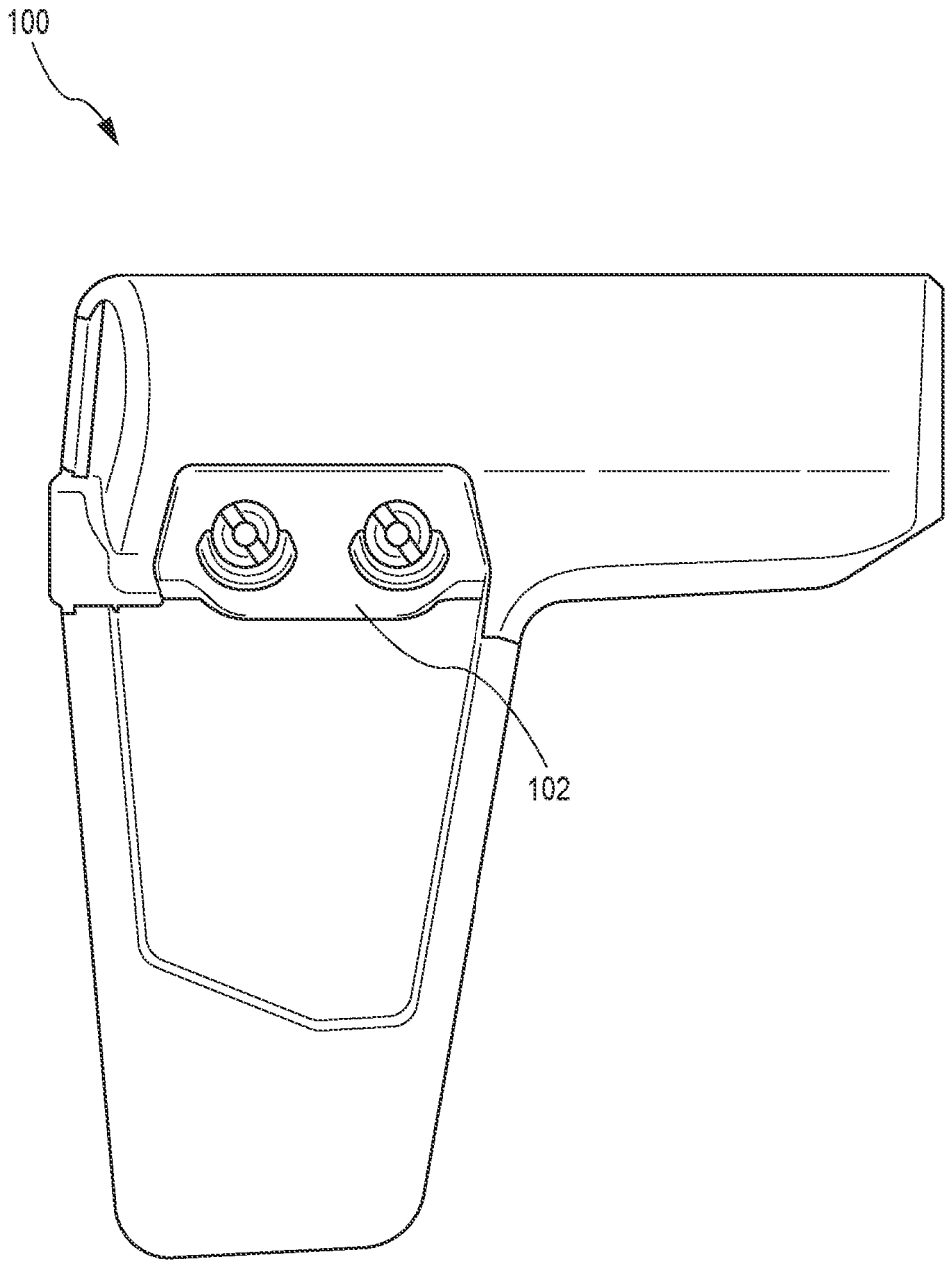
FIG. 2 illustrates a right-side view of the arm brace of FIG. 1.
Figure 3:
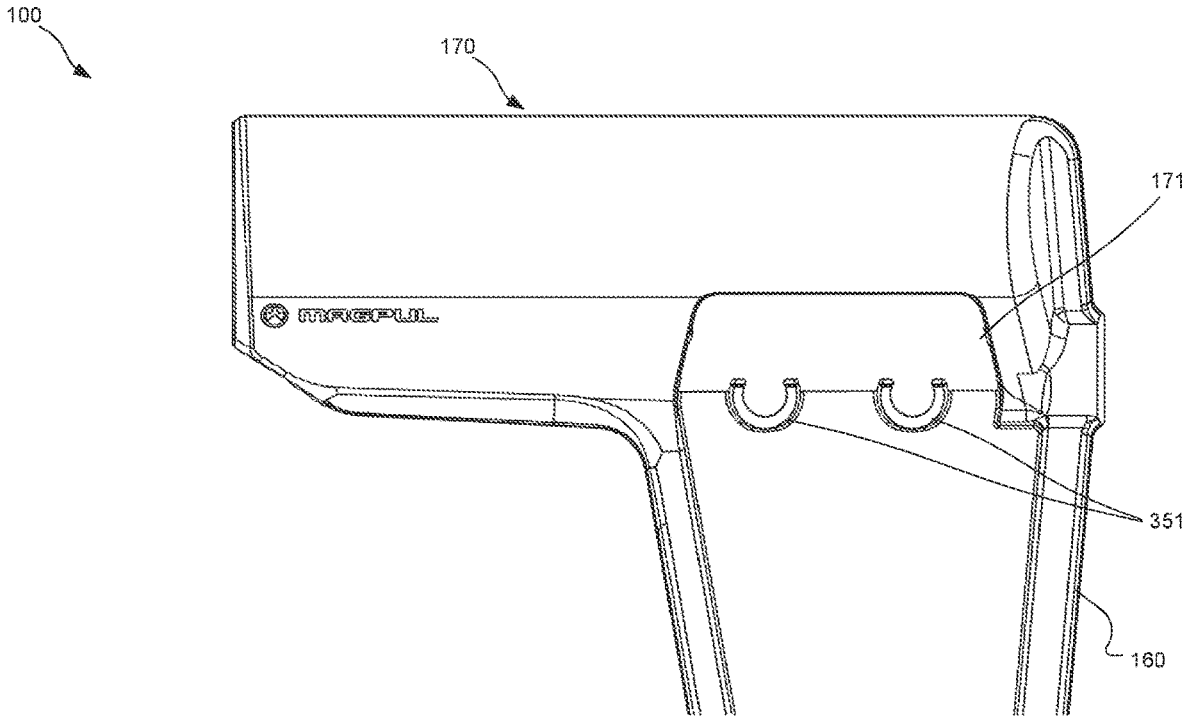
FIG. 3 illustrates a left-side view of the arm brace of FIG. 1 without the clamp mounting system.
Figure 23:
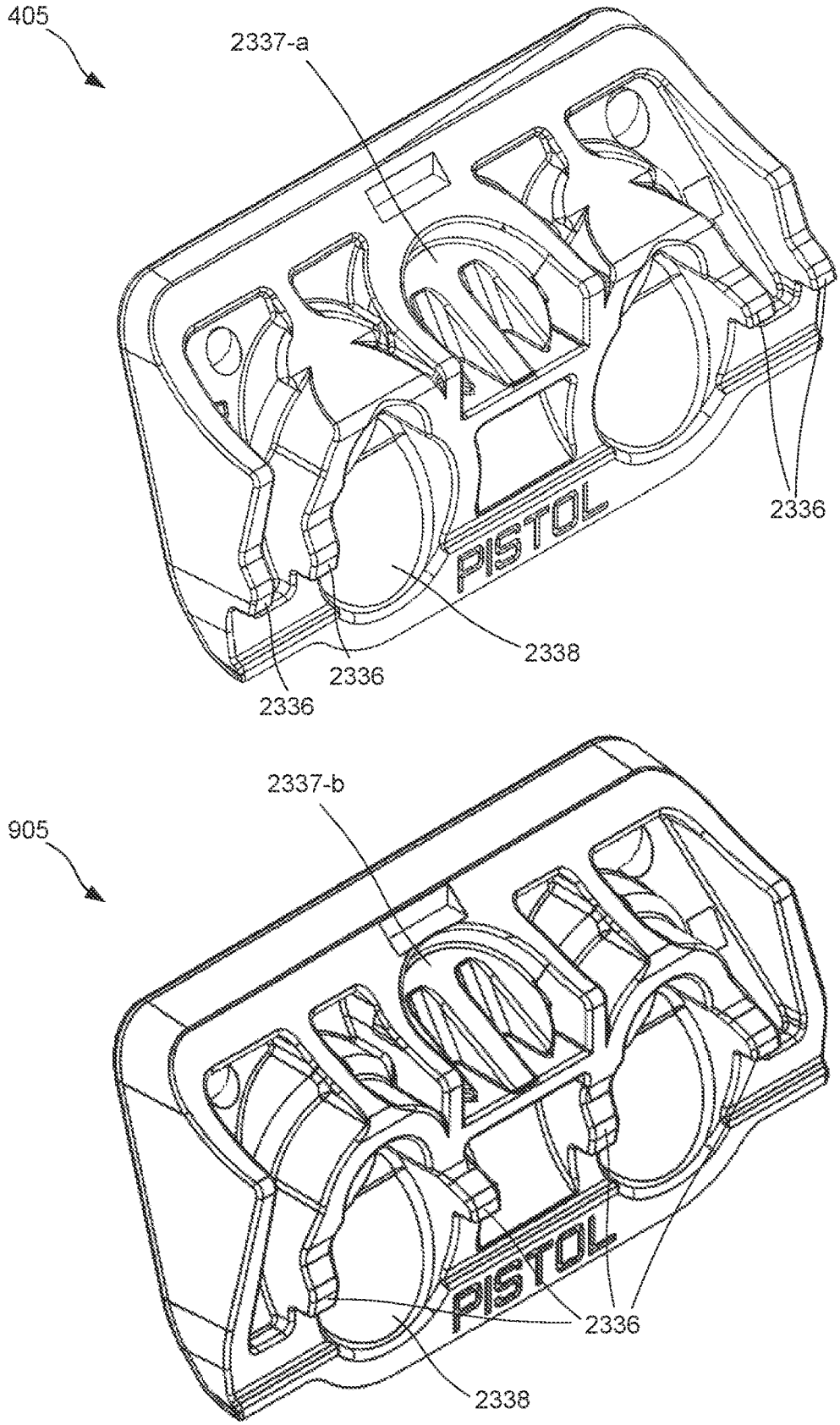
FIG. 23 illustrates a top perspective view of two halves of the clamp of the clamp mount system according to an embodiment of the present disclosure.

FIGS. 2 and 3 illustrate alternate views of the arm brace 100 in FIG. 1. FIG. 3 depicts a side view of the arm brace 100 without the clamp mounting system. As seen, the arm brace 100 includes a window 171 on each side (e.g., left side, right side) of the elongated body 170. In the example shown, the window 171 is positioned in the bottom half of the elongated body 170, for instance, at or near a junction between the elongated body 170 and the blade 160. In some cases, one or more protrusions 351 may be shaped and positioned along one edge (e.g., bottom edge) of the window 171. In some examples, the one or more protrusions may extend outward and may be shaped and sized to seat the one or more screws (e.g., shown as female screws 2514 and male screws 2514 in FIG. 25) of the clamp mount system. For instance, the inner diameter of the protrusions 351 may be sized to receive the outer diameter of the screw posts (e.g., shown as posts 2504 in FIG. 25). The protrusions 351 may hold the male and female screws extending (inward) from the sides of the arm brace 100. In some examples, each of the one or more protrusions 351 may be dimensioned to interface with a boss (e.g., shown as bosses 2336 in FIG. 23) of the clamp mount system. As seen in FIG. 23, the clamps (e.g., clamps 405 and/or 905) may further include a plurality of bosses 2336, one around each through-hole. These bosses 2336 may be molded in place and may facilitate in catching the inside bottom (e.g., protrusions 351) of the clamp window (e.g., window 171 in FIG. 3) within the clamp body. In some aspects, these bosses 2336 may serve to prevent the clamps from wandering downward during installation. In some circumstances, without these bosses 2336, the clamps may wander (e.g., downwards), which may reduce their clamping force on the receiver extension tube (or buffer tube) of the firearm. In some embodiments, the clamp mount system (e.g., clamp mount system 402 in FIG. 6) includes four bosses, two on each clamp 405. It should be noted that, different number of bosses may be utilized in different embodiments, and the examples listed herein are not intended to be limiting. For instance, in one non-limiting example, each clamp of the clamp mount system may include three through-holes (e.g., shown as through-holes 2338 in FIG. 23) for receiving three screws, or fasteners. In such cases, a total of six bosses may be included in the clamp mount system.

Figure 4:
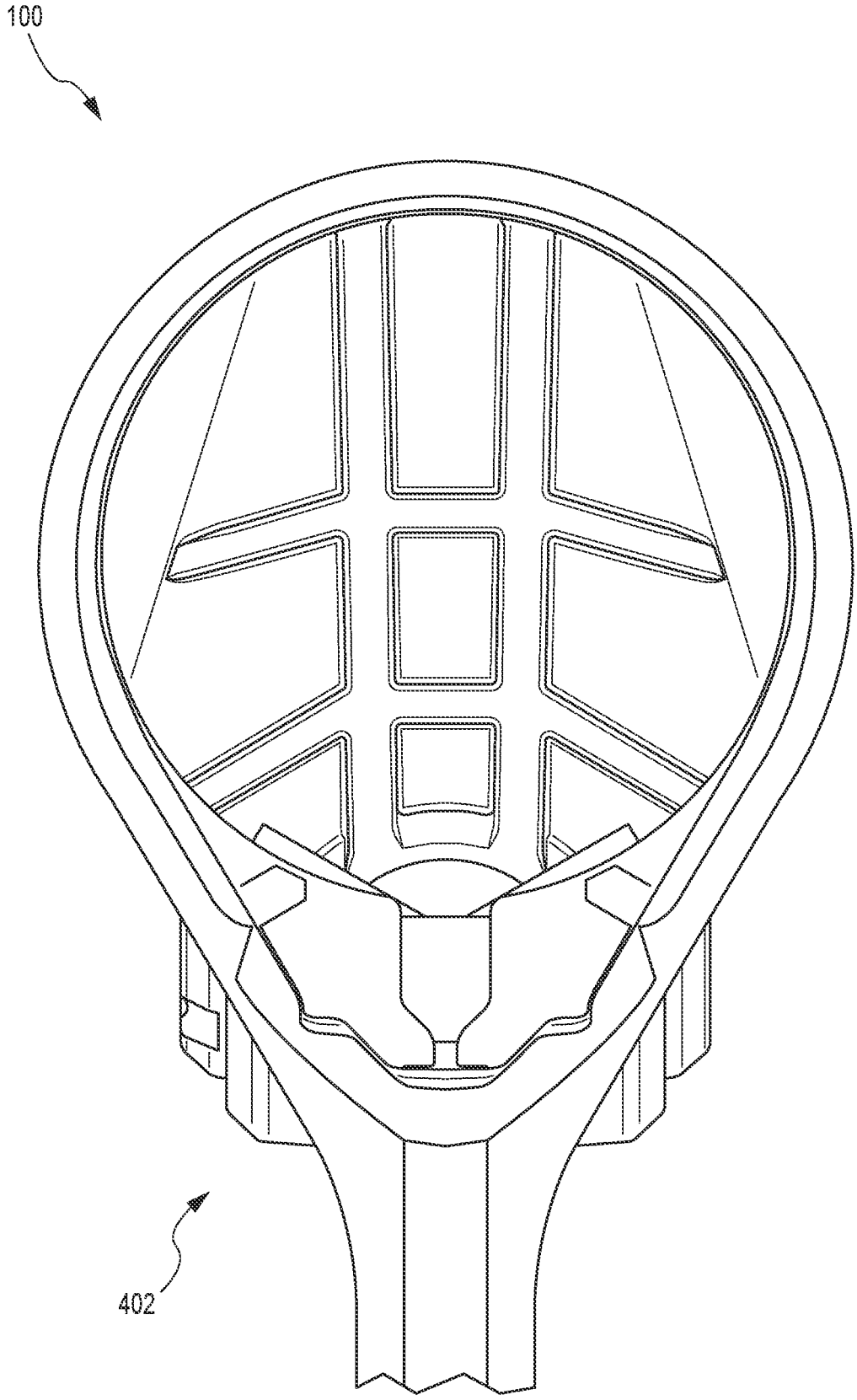
FIG. 4 illustrates a front view of the arm brace of FIG. 1.
Figure 9:
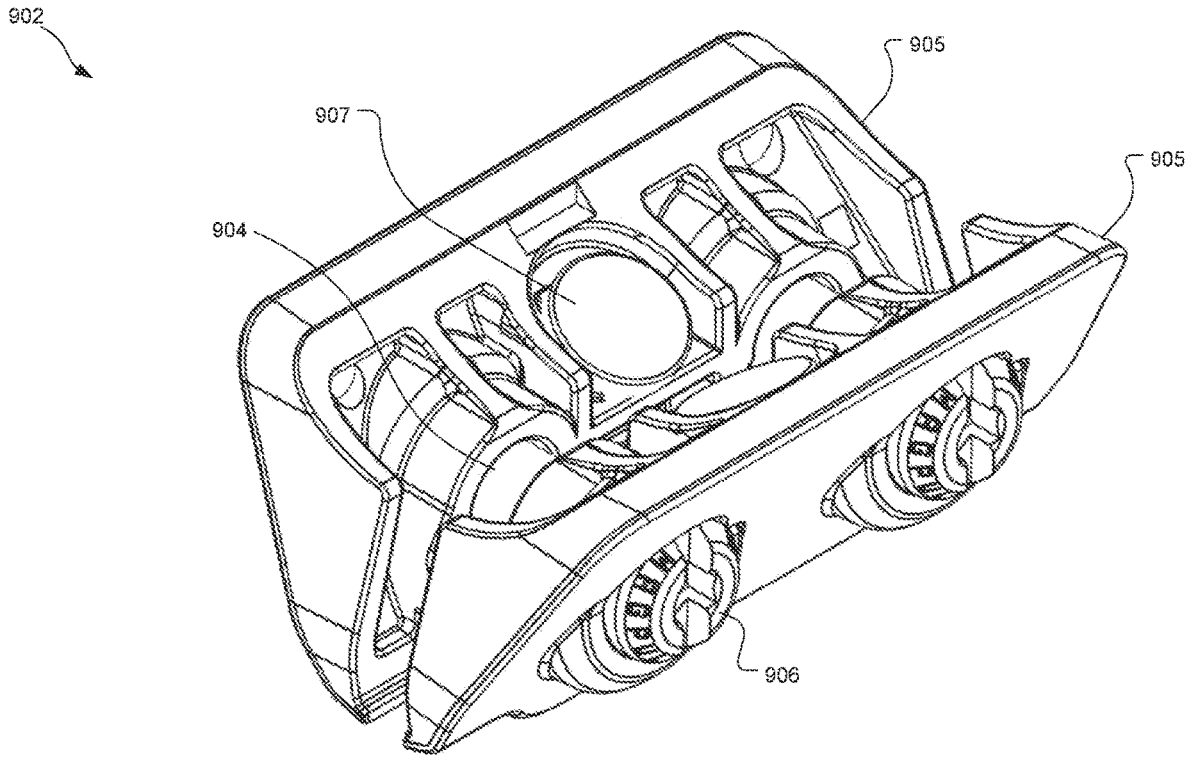
FIG. 9 illustrates a top perspective view of an alternate embodiment of the clamp mount system.
Figure 10:
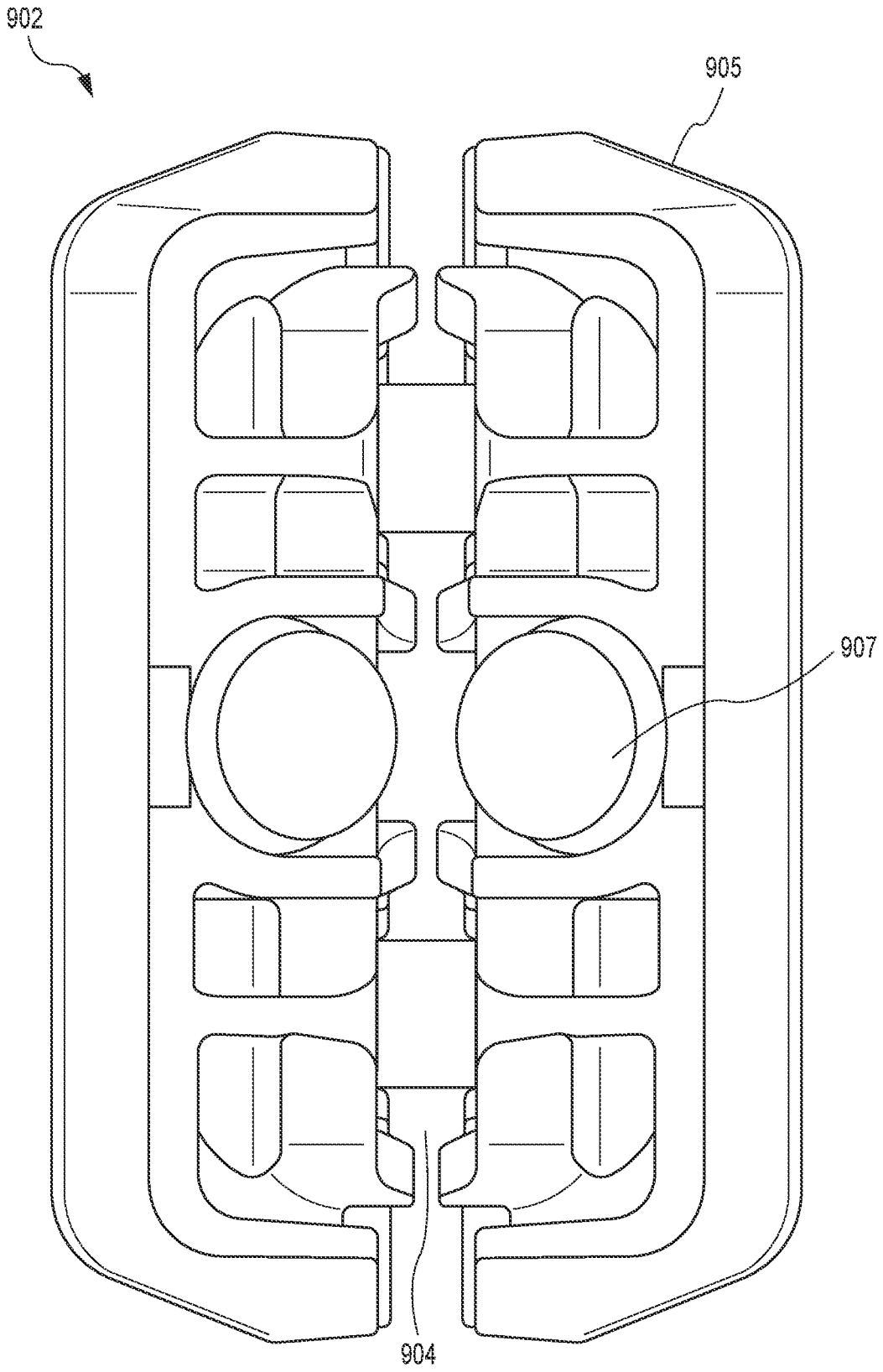
FIG. 10 illustrates a top view of the clamp mount system of FIG. 9.
Figure 11:
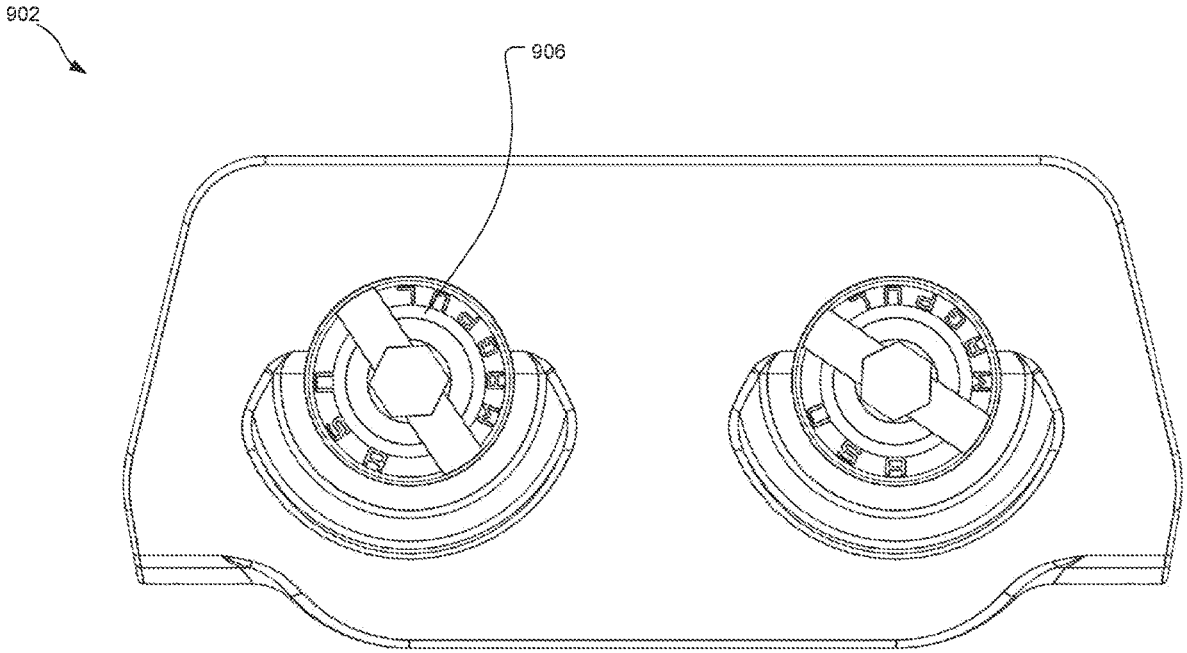
FIG. 11 illustrates a right-side view of the clamp mount system of FIG. 9.

FIG. 4 illustrates a front view of an arm brace 100, according to various aspects of the present disclosure. In this example, the arm brace 100 includes a clamp mount system 402, where the clamp mount system 402 is an example of a pistol clamp system. In some instances, pistol receiver extension tubes (e.g., round receiver extension tubes) have a cylindrical profile without an included keyway. In some embodiments, the clamp mount system 402 is configured to be used with different diameters of receiver extension tubes. In this example, the clamp mount system 402 is designed to have a snug fit on a "high side diameter" receiver extension tube. FIG. 9 illustrates an example of an alternate clamp mount system 902 that may be utilized with "low side diameter" receiver extension tubes.

Figure 5:
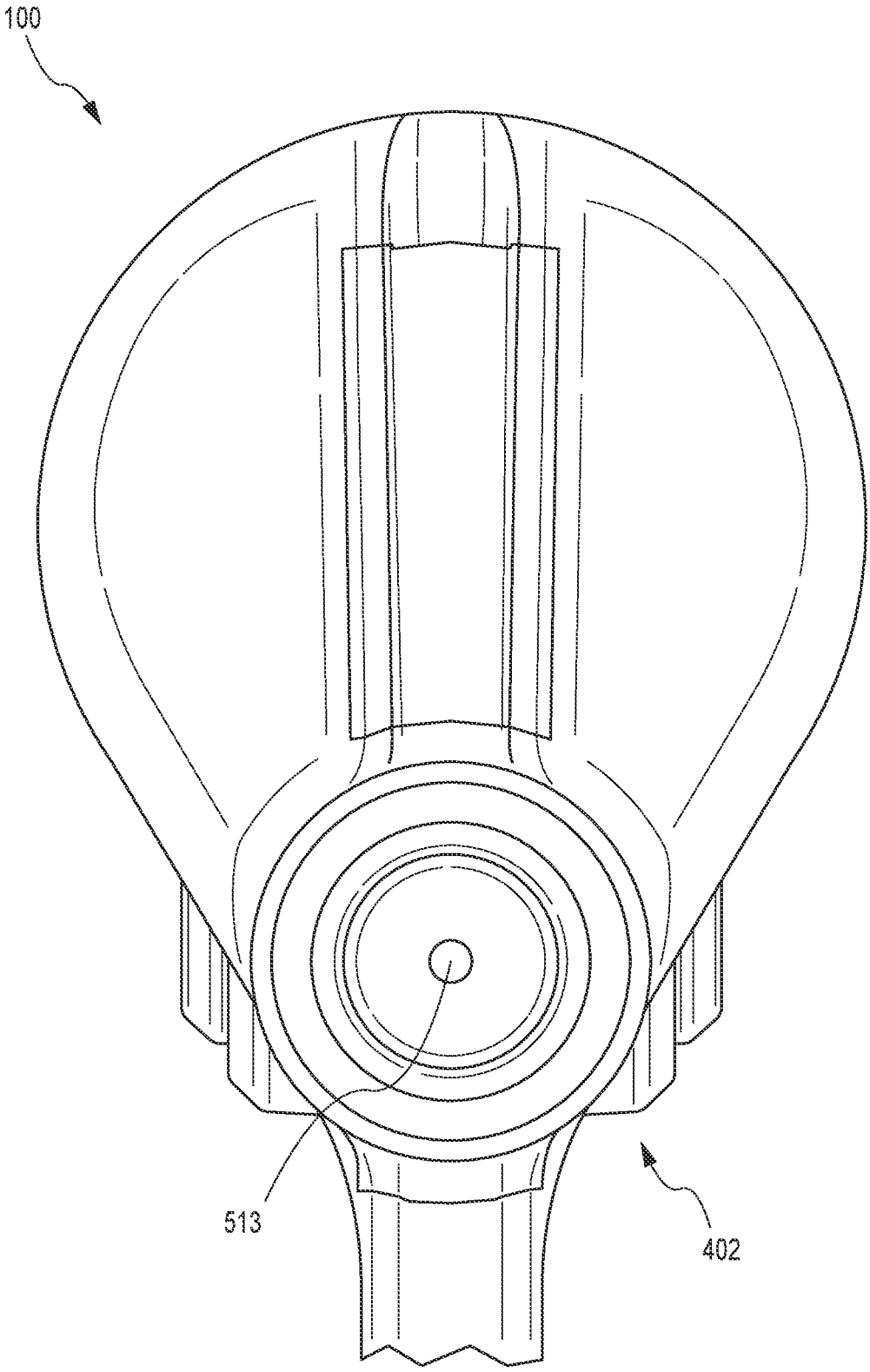
FIG. 5 illustrates a rear view of the arm brace of FIG. 1.

FIG. 5 illustrates a rear view of the arm brace 100, according to various aspects of the disclosure. As seen, the arm brace 100 includes an optional sling mount 513 for attaching a Quick Detach (QD) sling swivel (or QD socket) and sling to the proximal end of the arm brace 100. The optional sling mount 513 may be similar or substantially similar to the sling mount 113 in FIG. 1. In some cases, a user may attach a sling to a QD socket at the proximal (or rear) end of the arm brace 100, which may allow the user to brace the blade 160 against their forearm, for example, and stabilize the weapon using tension on the sling by pushing forward on the weapon.

Figure 6:
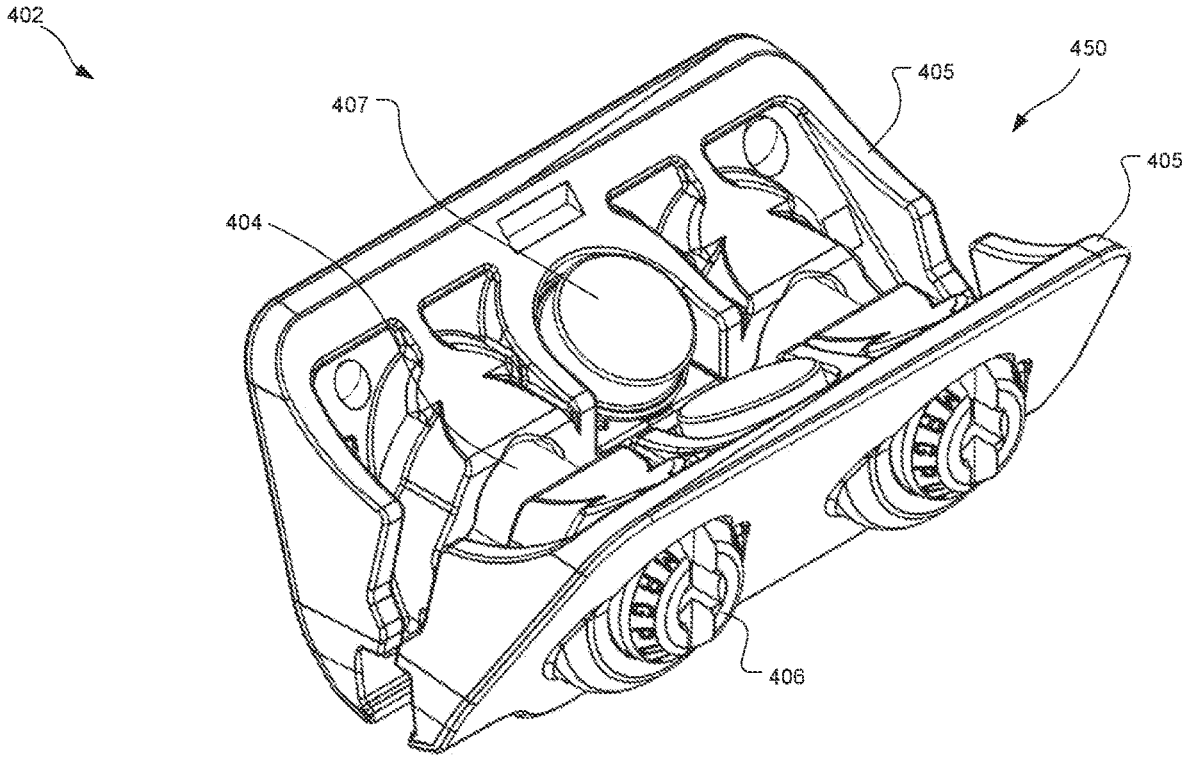
FIG. 6 illustrates a top perspective view of the clamp mount system.

FIG. 6 illustrates a perspective view of the clamp mount system 402, according to various aspects of the disclosure. As seen, the clamp mount system 402 includes two clamps 405, one or more through-holes (e.g., shown as through-holes 2338 in FIG. 23) on the sides of the clamps 405 to receive one or more screws 406 (e.g., male screws, female screws), and one or more recesses (e.g., shown as recesses 2337 in FIG. 23) to receive one or more pads 407. Alternatively, in some embodiments, the clamp 405 of the clamp mount system 402 may be formed from a single clamp 405 with one or more through-holes 2338. By non-limiting example, the clamp(s) 405 may be integrated with the blade 160 and elongated body 170 or may be separate components joined by a user to secure the arm brace 100 to the receiver extension tube of a firearm. While not necessary, in some examples, the pads 407 of the clamp mount system 402 may be adhesive-backed rubber pads or hard plastic or polymer with adhesive properties. In other instances, a softer over-molded polymer can be used to form the pads 407. Other types of flexible, elastic, and/or shape conforming pads may be utilized in different embodiments. Other types of hard, rigid, and/or molded pads may be utilized in different embodiments. In other words, the use of pads 407 is not intended to be limiting. In some examples, the recesses (e.g., recess 2937 in FIG. 29) may include one or more serrations 2987 (or other gripping projections), which may serve to grip the bottom surface of the pads 407 and help keep the pads 407 in place. In some instance, the recesses 2937 may include one or more adhesives, fasteners or other textured surfaces to grip the bottom surface of the pads 407. Such a design may also help prevent the pad and/or the arm brace from rotating relative to the receiver extension tube. While, in its absence, the arm brace may rotate freely relative to the receiver extension tube, while still preventing proximal or distal movement of the arm brace along a longitudinal axis.

In some cases, each of the fasteners (e.g., screws) 406 may be shaped and sized to extend through at least a portion of the one or more clamp(s) 405. For instance, each clamp 405 may include a first and a second opening, where the first opening is on an exterior of the clamp and the second opening is on an interior of the clamp (i.e., adjacent the receiver extension tube). The first and second openings may be connected or aligned, thereby forming a through-hole on the side of the clamp 405. In other instances, the clamp 405 itself may comprise a male or female receiving portion configured to receive, for example, a male (e.g., male screws 2512 in FIG. 25) or female (e.g., female screws 2514) screw 406. Such a design would serve to reduce the number of removable parts while serving the same or similar function as the through-holes. In some cases, the clamp 405 on a first side (e.g., left side) of the arm brace may receive a first type of screws (e.g., male screws 2512 in FIG. 25) in its through-holes, while the clamp 405 on the opposing side (e.g., right side) of the arm brace may receive another type of screws (e.g., female screws 2514) in its through-holes. In some cases, each of the female screws may be partially hollow, for instance, may include a longitudinal channel or cavity extending along at least a section of the screw. Further, the inner channels of the female screws (e.g., screws 2514 in FIG. 25) may be threaded, as shown by threads 2524. The screws (i.e., male and female screws) may be shaped and sized to enable the outer threads (e.g., outer threads 2522) of the male screws to mate with the inner threads 2524 of the female screws. In other words, the inner diameter of a female screw may be sized to receive an outer diameter of a male screw so as to couple the male and female screws. In some cases, each screw may include a screw head accessible from an outside of the arm brace 100. The screws in each screw set may be designed to be independently tightened. As used herein, the term "screw set" refers to a set of screws having one male and one female screw. In some embodiments, a user may be able to tighten either the male or the female screw in a screw set to tighten the clamp and thereby increase the clamping force on the receiver extension tube.

In some examples, a user of the arm brace may first determine the diameter of their receiver extension tube to identify which clamp mount system 402 will best fit their tube before installing the pads on the clamps. As the clamps (e.g., clamps 405) are mounted and screwed into place, any slop or gap created by varying receiver extension tube diameters may be taken up by the pads (e.g., pads 407). Alternatively, the clamp mount system 402 may be a universal mounting system capable of fitting receiver extension tubes of any diameter. Such a universal mounting system may be formed from a single unitary clamp 405 with a plurality of fasteners 406 or may be formed by two or more clamps 405.

Figure 7:
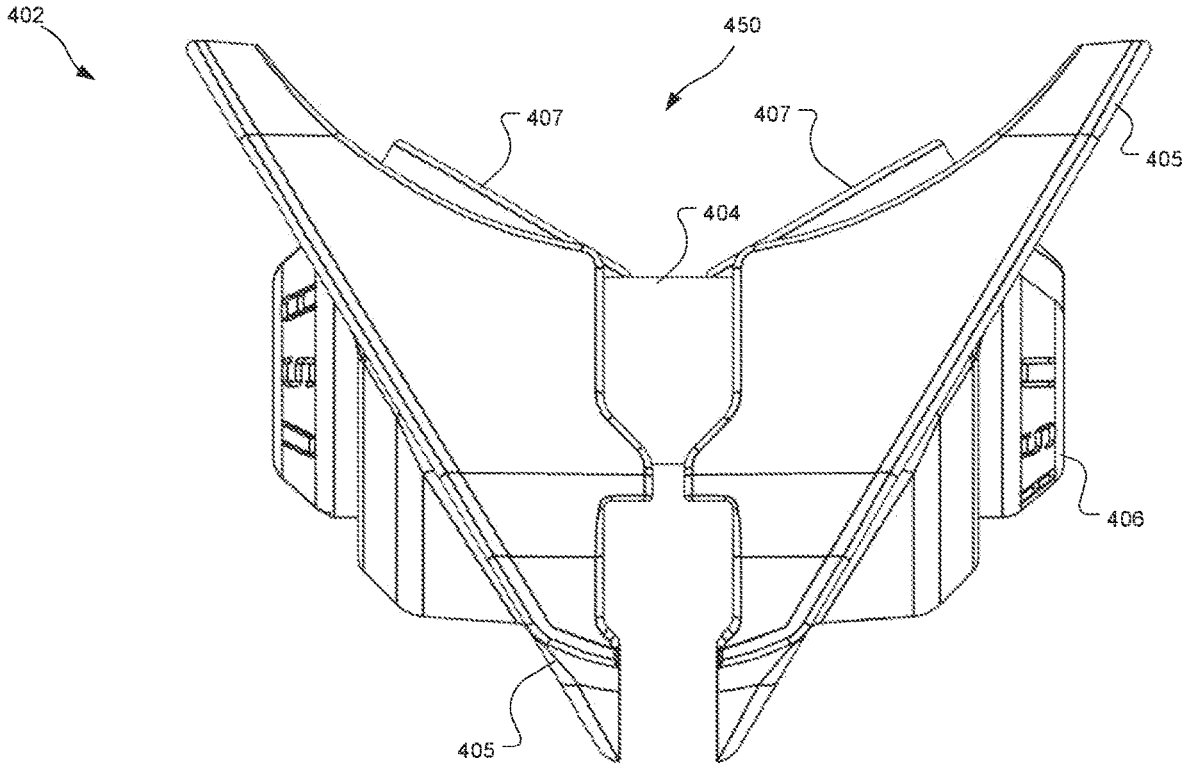
FIG. 7 illustrates a front view of the clamp mount system of FIG. 6.

FIG. 7 illustrates a front view of a clamp mount system 402, in accordance with one or more implementations. As seen, the clamp mount system 402 includes two clamps 405, each having a pad 407. The clamp mount system 402 further includes one or more screw sets (fasteners) 406, each having a male screw and a female screw. In some examples, the screw sets 406 are received within through-holes on the sides of the clamps and extend from an outside of one of the clamps 405 to an outside of the other of the clamps. In some instances, the male screws 406 engage with female receiving portions in the through-holes to affix the clamp mount system 402 to the arm brace 100. In some cases, two screw heads (e.g., one corresponding to the male screw and one for the female screw), from each screw set, may be accessible from the left-right sides of the arm brace. The two screw heads may both be male screw heads and may be on either side of the clamp mount system 402. In some examples, each female screw (i.e., extending from one side of the arm brace) of a screw set 406 includes a hollow post 404, where the hollow post 404 extends between the two clamps 405. The hollow post 404 may be threaded and may be configured to receive at least a portion of the male screw (i.e., extending from the opposing side of the arm brace) of the screw set 406. In some instance, the post 404 may be a solid, rigid threaded bar configured to receive two female screws 406 from both sides of the post, wherein the female screws 406 engage with the post to tighten the clamp mount system 402.

As seen, the clamp mount system 402 forms a channel 450, where the channel 450 is disposed between the inner faces of the clamps 405. The channel 450 may be shaped and sized to receive at least a portion of the receiver extension tube (or buffer tube) of the firearm. In some cases, a user may vary the diameter of the channel 450 by adjusting (e.g., tightening, loosening) the male and/or female screws of the screw sets 406. For instance, tightening the screws may bring the two clamps 405 mounted on the sides of the arm brace body closer together, thus reducing the diameter of the channel 450. Contrastingly, loosening the one or more screws of the screw set(s) 406 may cause the two clamps 405 to move apart (e.g., to the left and to the right, respectively, in FIG. 7), which may serve to increase the diameter of the channel 450. In some instances, the channel 450 may partially or fully encase the receiver extension tube. In other embodiments, adjusting the screws 406 serve to tighten or loosen a single clamp 405 formed to encase the receiver extension tube partially or fully. In some examples, a user may adjust the screws until the pads 407 are in contact (e.g., provide a snug and/or tight fit) with the outside diameter of the receiver extension tube. In some embodiments, the pads 407, may be configured to engage the extension receiver tube from a bottom portion and/or a top portion of the outside diameter of the receiver extension tube. As noted above, any slop or gap created between the clamps 405 and the receiver extension tube may be taken up by the rubber pads. In this way, the arm brace 100 may be fixed in position relative to the extension or buffer tube of the firearm.

FIG. 9 illustrates a perspective view of a clamp mount system 902, according to an alternate embodiment of the disclosure. In some examples, the clamp mount system 902 implements one or more aspects of the clamp mount system 402, previously described in relation to FIGS. 4-7. As seen, the clamp mount system 902 includes a plurality of clamps 905, a plurality of screw sets (fasteners) 906 extending between the clamps 905, and at least one pad 907 on one or more clamp(s) 905. The screw sets 906 may be similar or substantially similar to the screw sets 406 described in relation to FIGS. 6 and/or 7. In some cases, each screw set 906 may include a male screw received within a through-hole of a clamp 905 on a first side of the arm brace and a female screw received within a through-hole of another clamp 905 on an opposing side of the arm brace. The male and female screws may be shaped and sized to mate with each other or may be configured to mate with a post 404 positioned between the through-holes of the clamp 905. For instance, at least a portion of the male screw may be designed to be threaded to an interior of the female screw. In some cases, each female screw may include a hollow post 904 (i.e., similar or substantially similar to the hollow post 404 described in relation to the preceding figures), where the hollow post 904 may be threaded.

Figure 12:
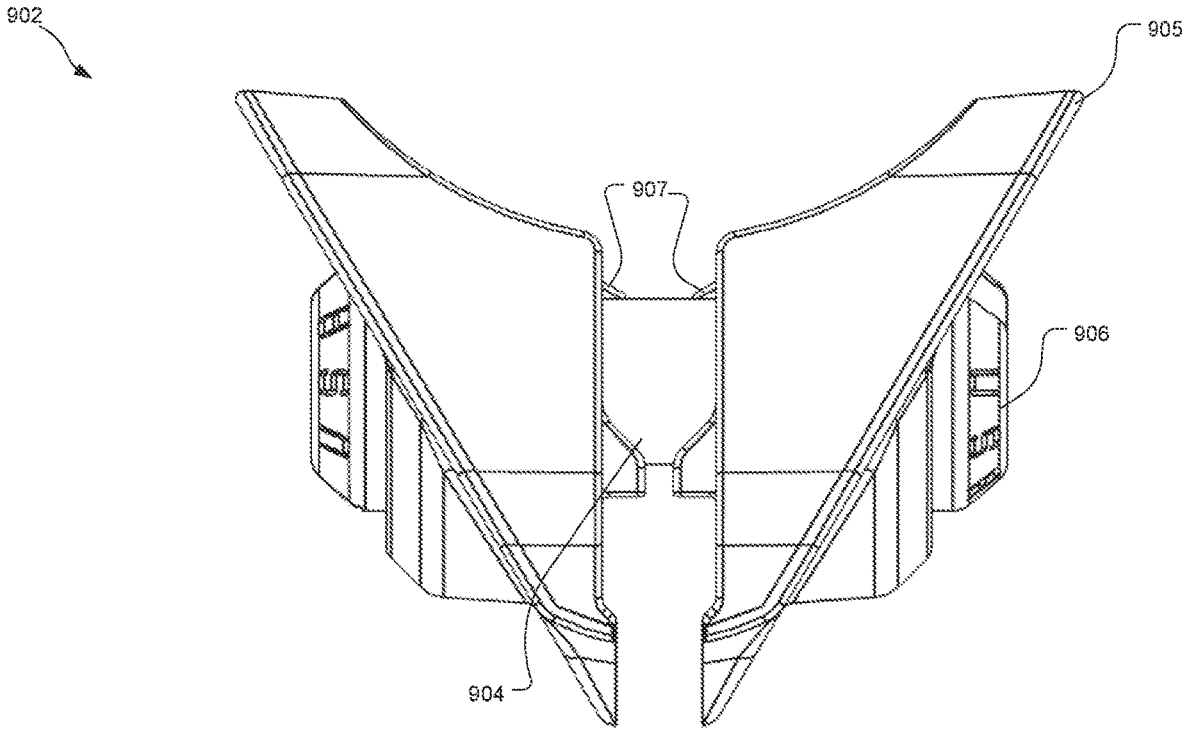
FIG. 12 illustrates a front view of the clamp mount system of FIG. 9.
Figure 13:
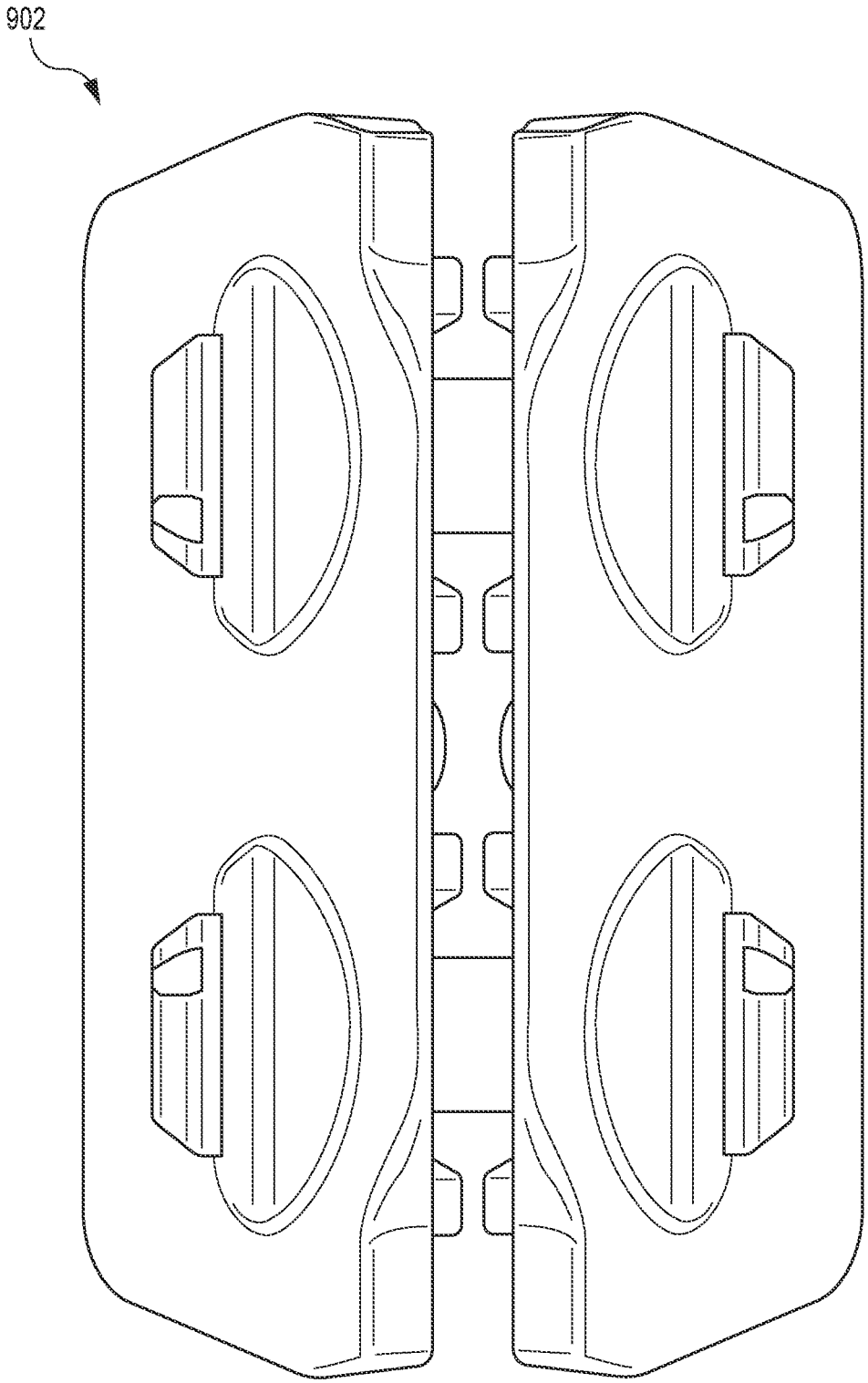
FIG. 13 illustrates a bottom view of the clamp mount system of FIG. 9.
Figure 14:
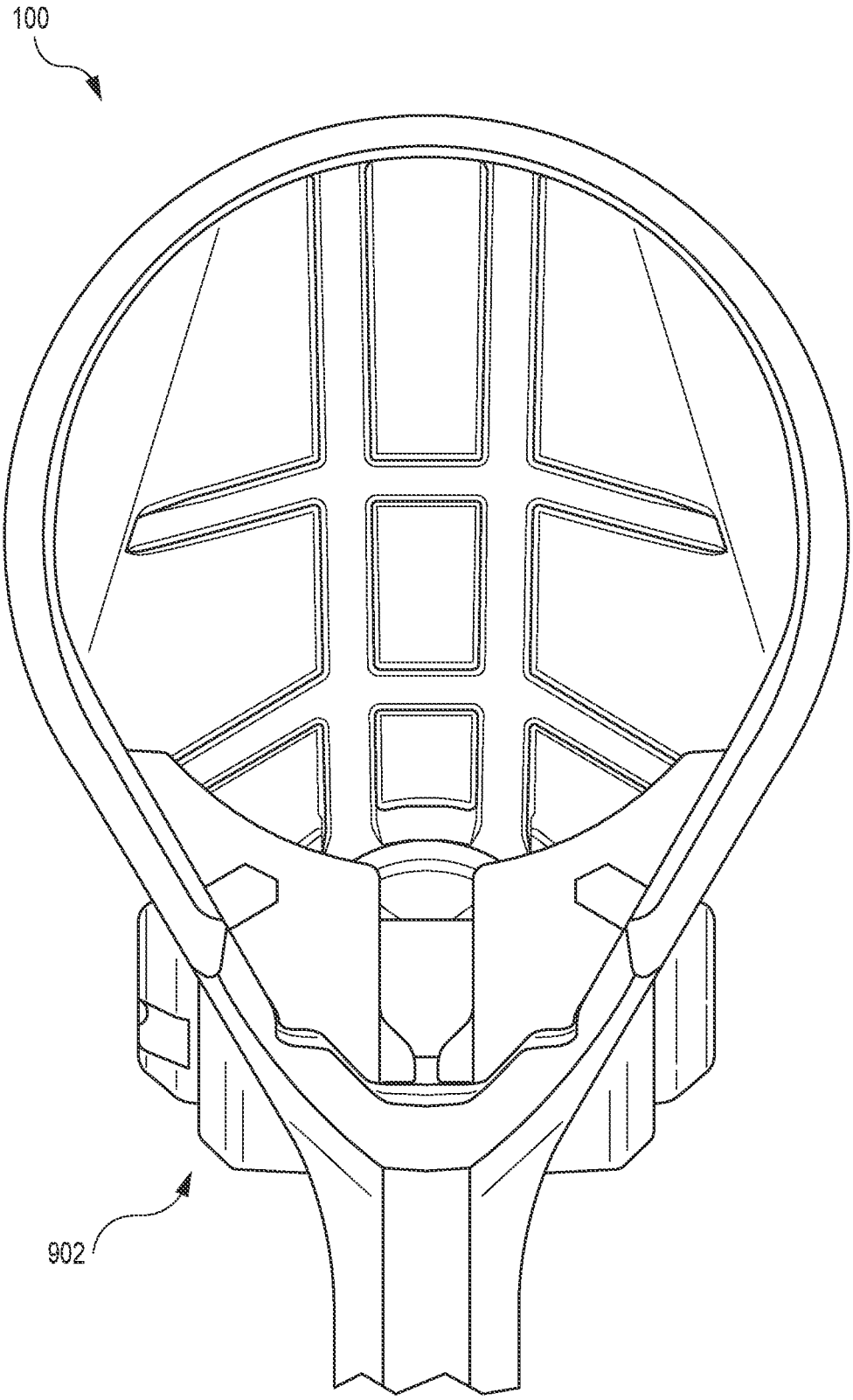
FIG. 14 illustrates a front view of an alternate embodiment of the arm brace.

In some embodiments, the clamp mount system 902 may be adapted for use with "low side diameter" extension tubes. As compared to the pads 407 in the clamp mount system 402, the pads 907 may be seated lower within the respective cavities/recesses of the clamps 905. For instance, when viewed from the front (e.g., in FIG. 12), a significantly smaller portion of the pads 907 may be visible, as compared to the pads 407 in FIG. 7.

FIGS. 9-14 depict alternate views of the clamp mount system 902, in accordance with various aspects of the disclosure.

Figure 8:
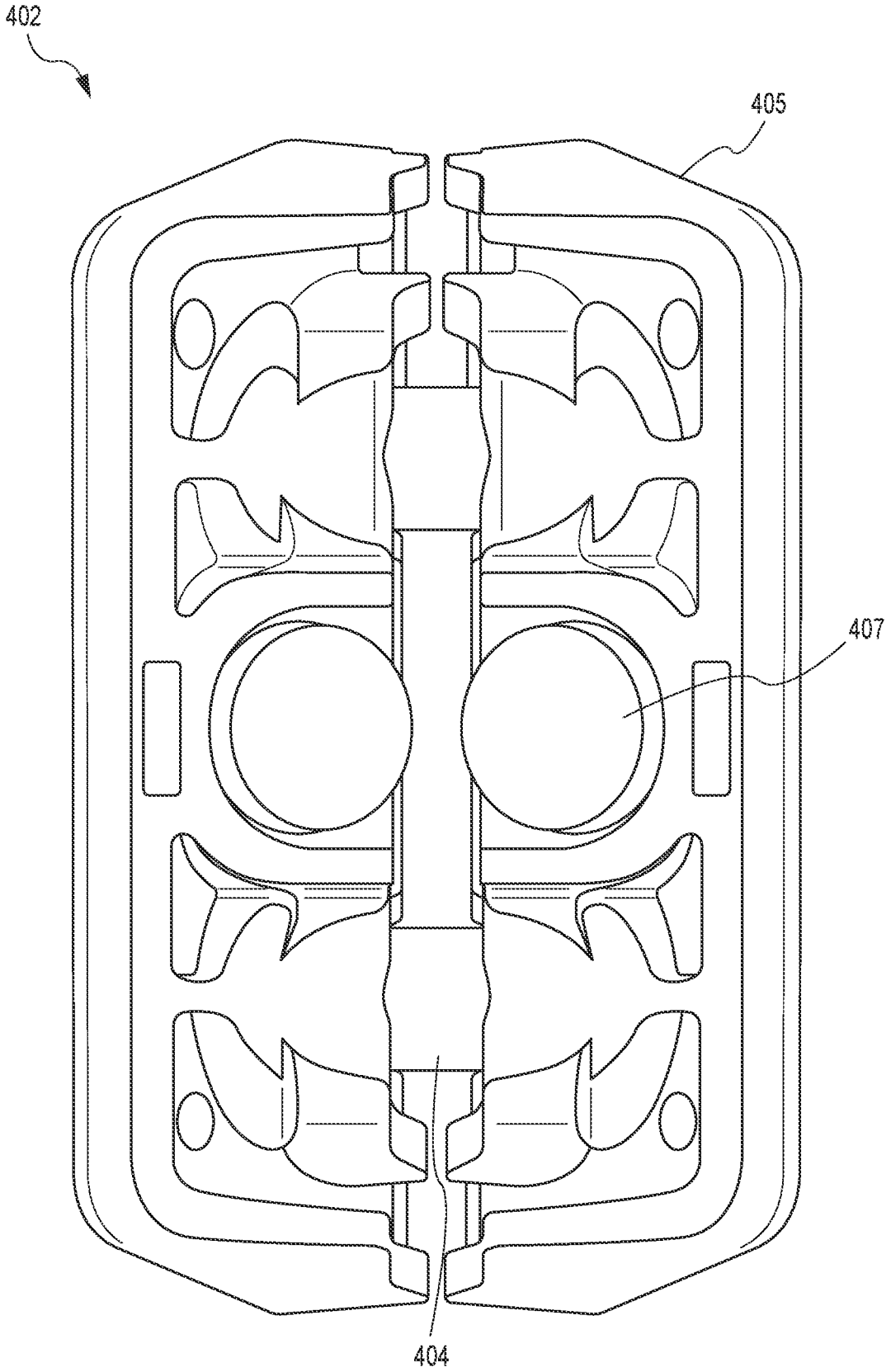
FIG. 8 illustrates a top view of the clamp mount system of FIG. 6.
Figure 15:
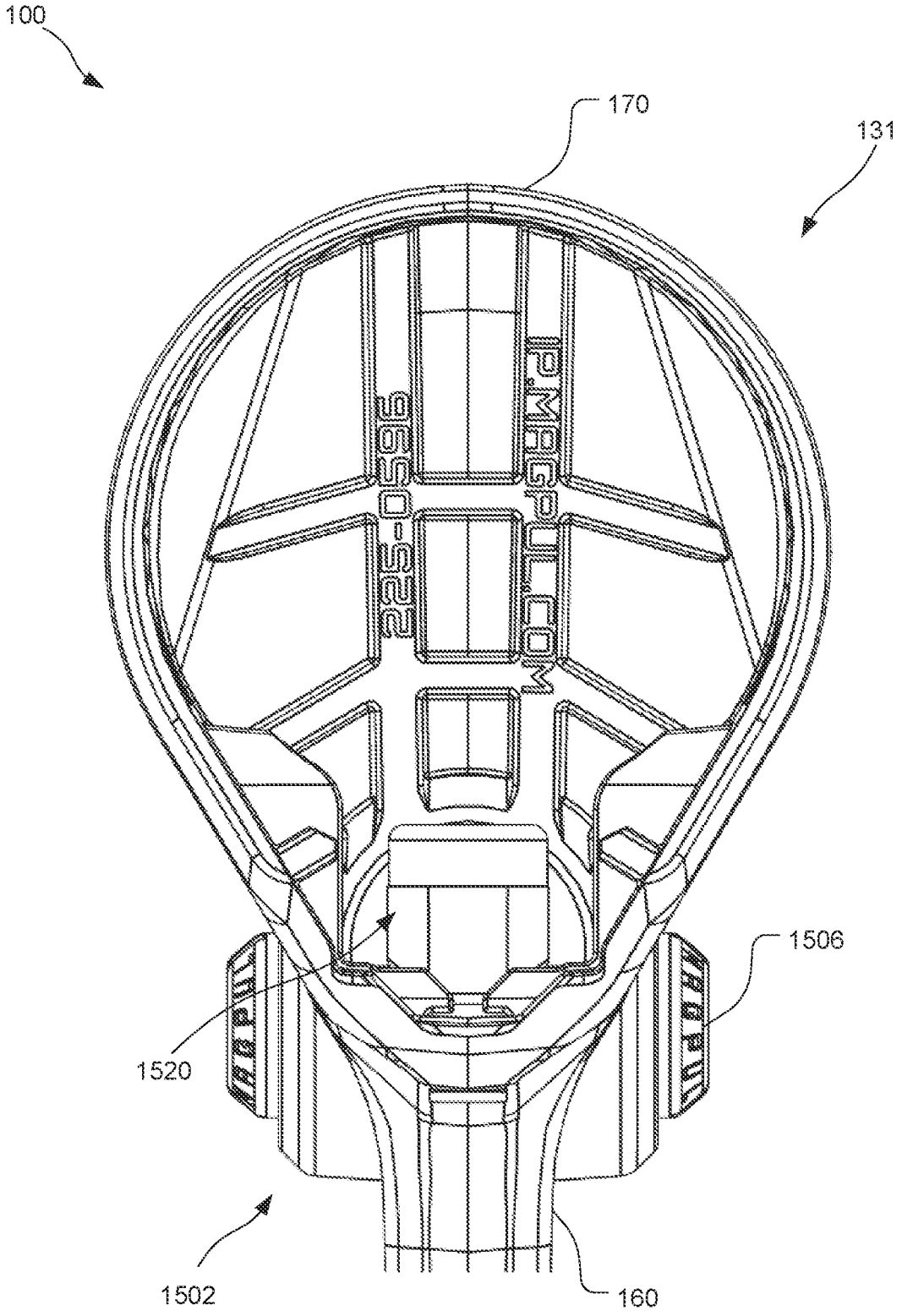
FIG. 15 illustrates a front view of yet another alternate embodiment of the arm brace.

Turning now to FIG. 15, which illustrates an example of an arm brace 100 with a clamp mount system 1502, according to an alternate embodiment of the disclosure. Although not necessary, in some cases, the clamp mount system 1502 may be an example of a clamp mount system adapted for use with keyed receiver extension tubes, such as those of the Mil-Spec type. In some circumstances, Mil-Spec receiver extension tubes may include a keyway and may have tighter tolerances with minimal tube-to-tube variations (i.e., in cross-sectional dimensions) as compared to round receiver extension tubes, for instance, "pistol type" extension tubes. As seen, the clamp mount system 1502 includes one or more screw sets 1506 received within a plurality of through-holes of the clamps. The screw sets 1506 may be similar or substantially similar to the screw sets 406 and/or 906 previously described in relation to FIGS. 6-8. In some embodiments, the screw set(s) 1506 may be configured to extend between the clamps of the clamp mount system 1502 and may be utilized to vary the separation between the two clamps. In some aspects, the screw set(s) (fasteners) 1506 may be utilized to adjust the clamping force applied by the clamps on the receiver extension tube. In some instances, the screw set(s) 1506 are integrated into the clamp mount system 1502 and are similarly configured to adjust the clamping force.

In this example, the clamp mount system 1502 further includes an insert 1520 that is shaped and sized to fit into a tube positioning hole (may also be referred to as a tube locking hole, or simply, locking hole) of a receiver extension tube (not shown, maybe a keyed receiver extension tube of the "Mil-Spec" type). In some examples, at least a portion of the insert 1520, for instance, vertical section 1516 in FIG. 22, may be shaped and sized to fit into the rear-most locking hole. In some examples, a user may insert the vertical section 1516 of the insert 1520 into the rear-most tube locking hole of the extension tube before sliding the arm brace body over the tube until the brace bottoms out (i.e., such that the distance between the vertical section 1516 of the insert 1520 and the proximal end of the arm brace is minimized). In such cases, a majority (or entirety) of the length of the arm brace 100 extends over the receiver extension tube. Next, one or more clamps of the clamp mount system 1502 may be placed into position through the windows (e.g., shown as window 171 in FIG. 3) on the sides of the arm brace 100. In some cases, each screw set(s) 1506 may include a plurality of screws or fasteners (e.g., one male screw, one female screw), where the screws or fasteners may be used to clamp or lock the arm brace 100 in place relative to the receiver extension tube.

Figure 16:
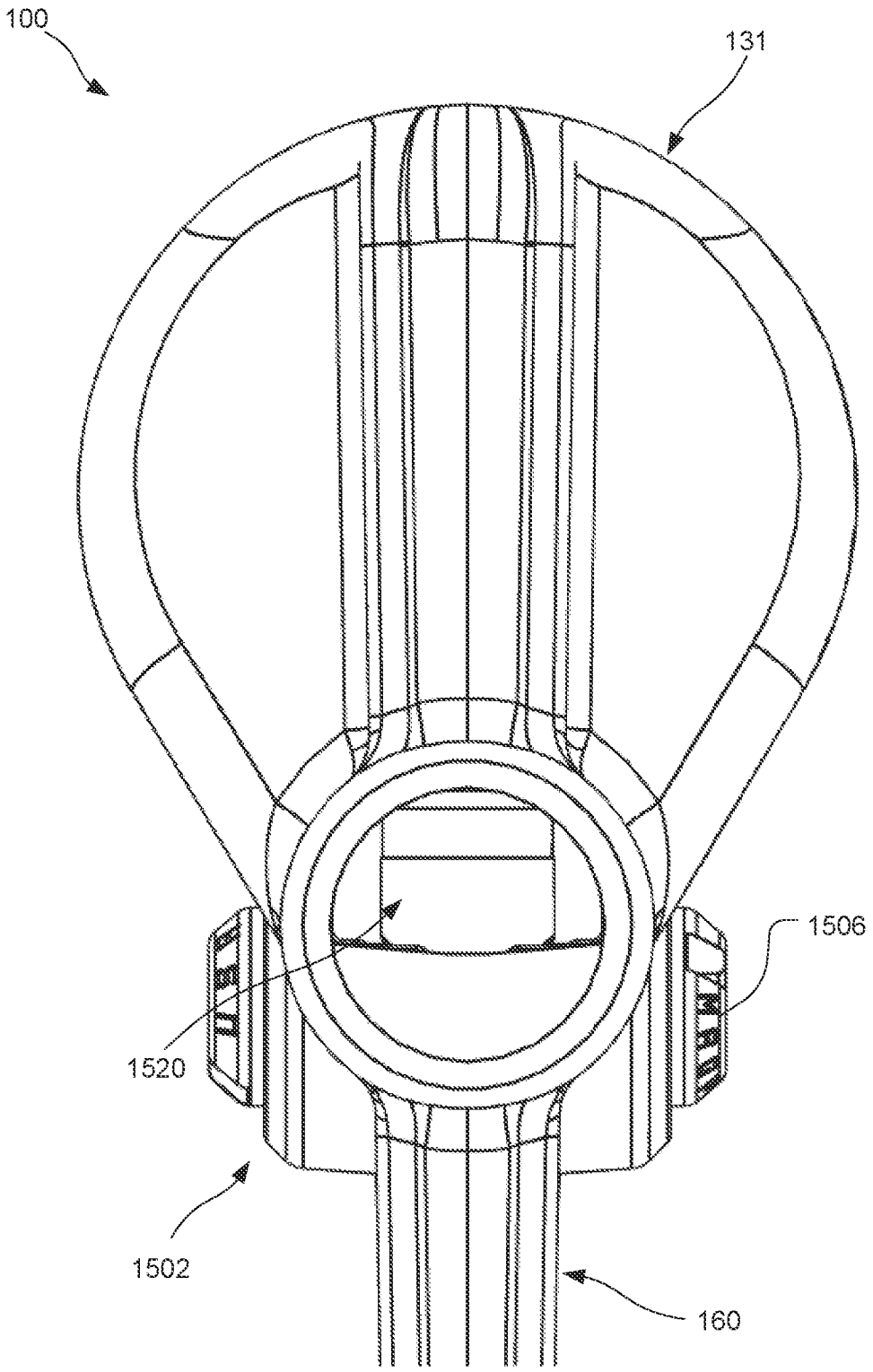
FIG. 16 illustrates a rear view of the arm brace of FIG. 15.
Figure 17:
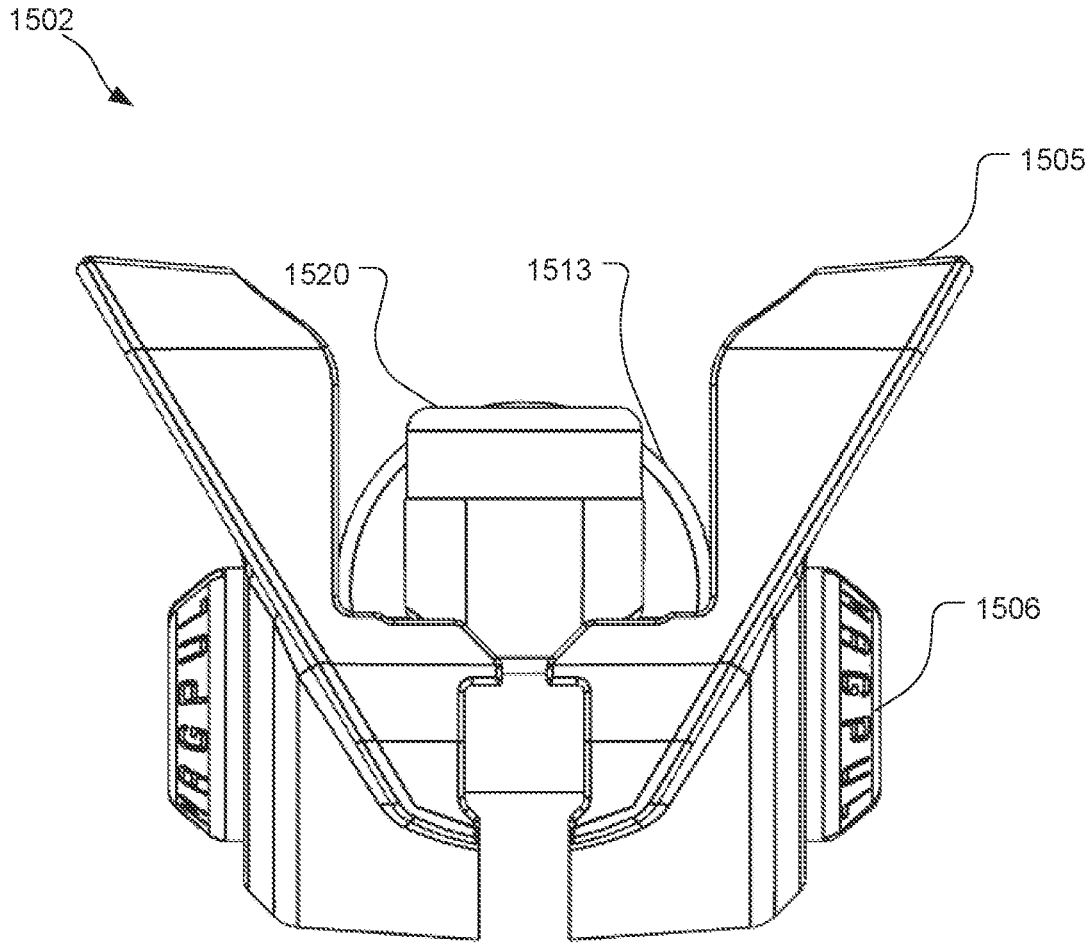
FIG. 17 illustrates a front view of an alternate embodiment of the clamp mount system with a sling mount coupler and an insert, wherein the insert keys into a mil-spec receiver extension tube to lock the brace into position fore-aft when used with the mil-spec receiver extension tube.
Figure 18:
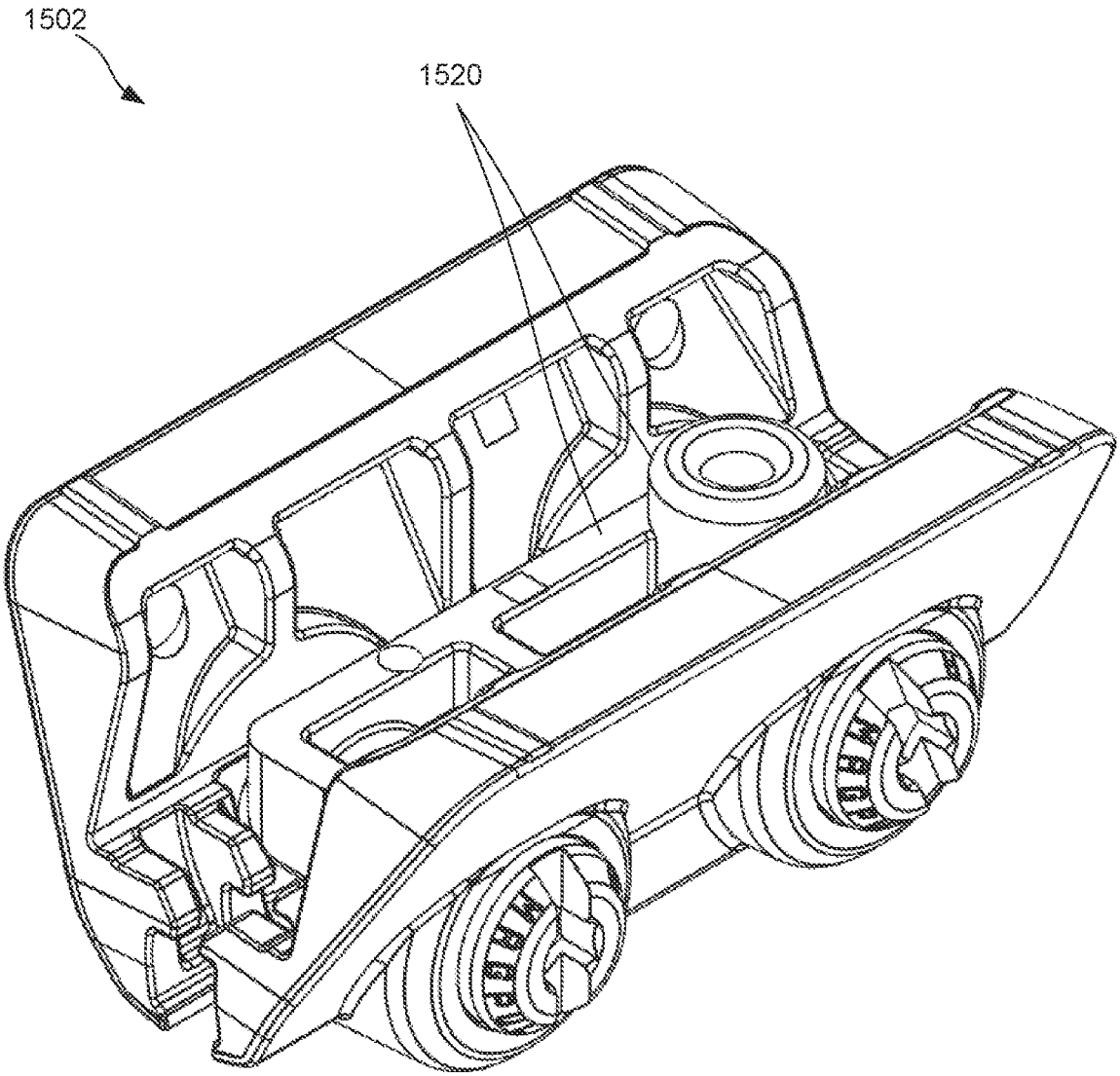
FIG. 18 illustrates a perspective view of an alternate embodiment of the clamp mount system with an insert.
Figure 19:
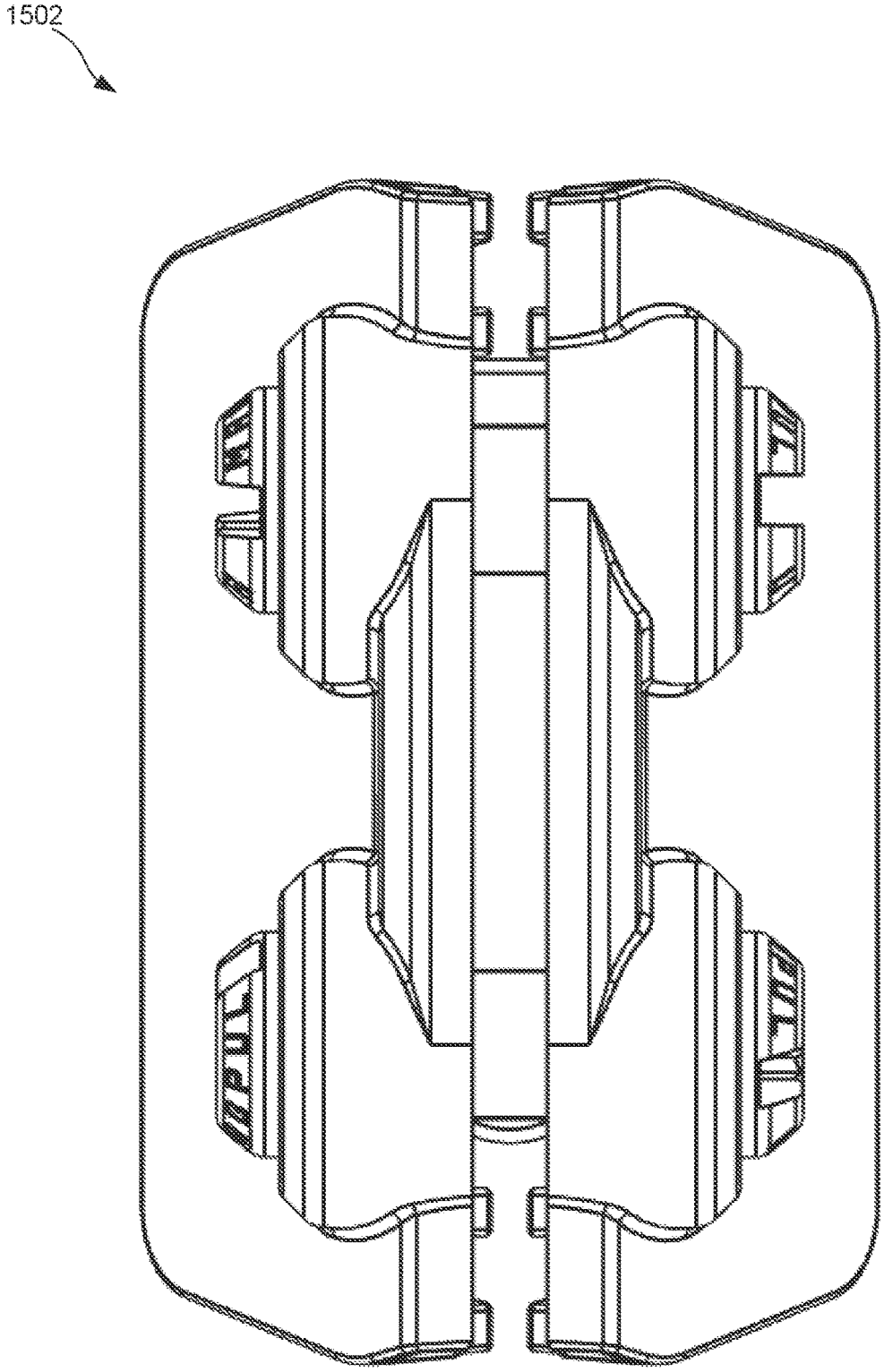
FIG. 19 illustrates a bottom view of the clamp mount system of FIG. 18.
Figure 20:
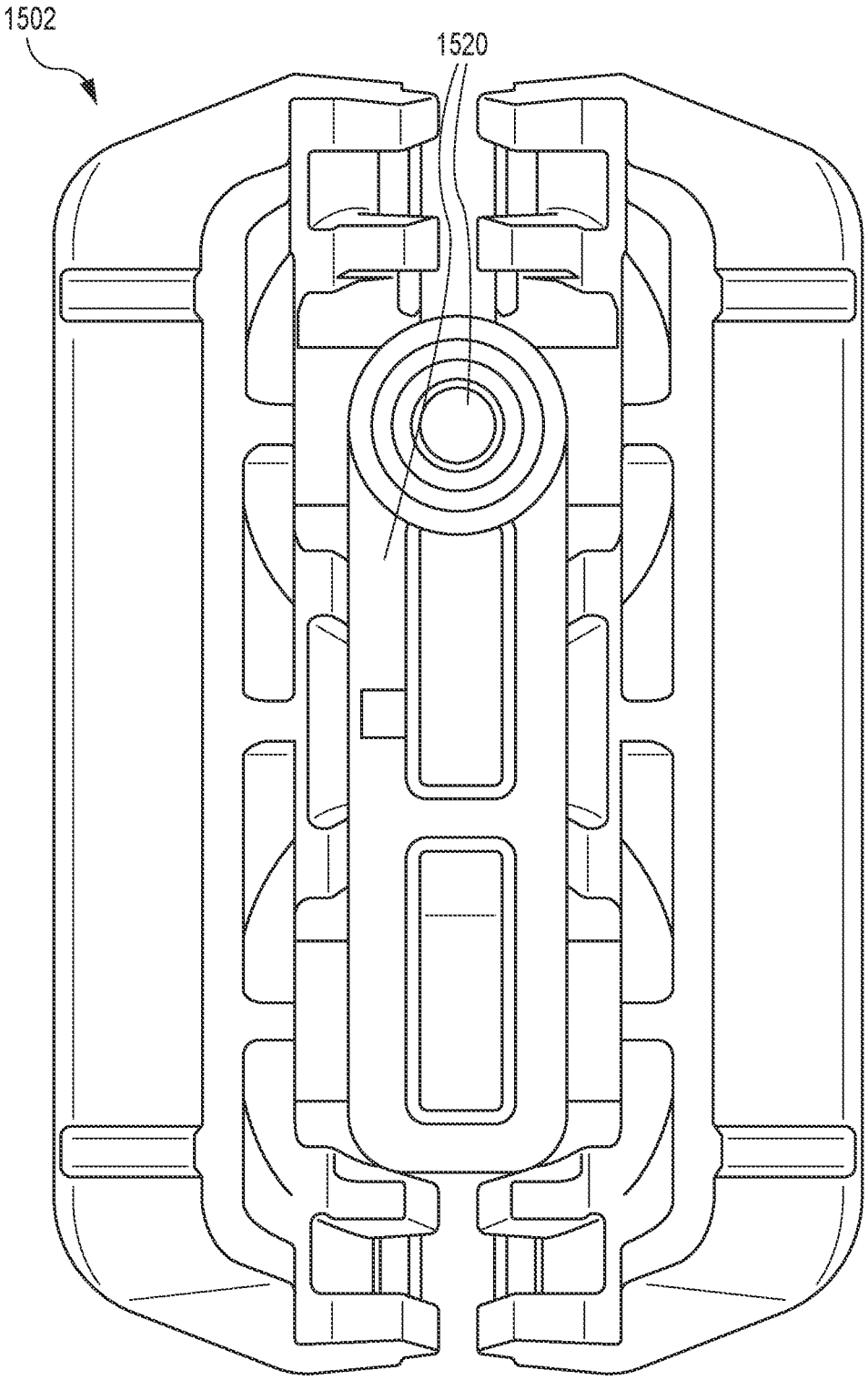
FIG. 20 illustrates a top view of the clamp mount system of FIG. 18.
Figure 21:
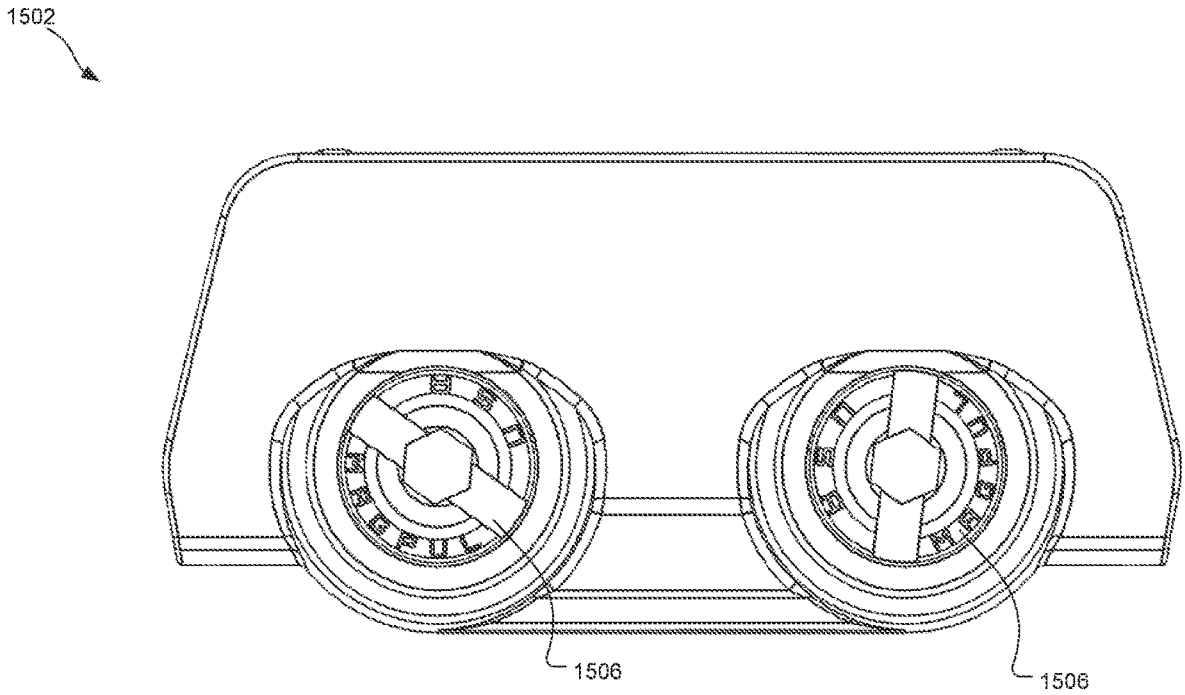
FIG. 21 illustrates a right-side view of the clamp mount system of FIG. 18.

FIG. 16 illustrates a rear view of the arm brace 100 including the clamp mount system 1502, as previously described in relation to FIG. 15. FIG. 17 illustrates a front view of the clamp mount system 1502, according to various aspects of the disclosure. FIG. 17 also depicts an optional sling mount 1513 coupled to a proximal end of the arm brace. The sling mount 1513 may be similar or substantially similar to the sling mount 113 and/or 513 seen in FIGS. 1 and/or 5. FIG. 18 illustrates a detailed perspective view of the clamp mount system 1502. FIG. 19 illustrates a bottom view of the clamp mount system 1502. FIG. 20 illustrates a top view of the clamp mount system 1502. FIG. 21 illustrates a side view of the clamp mount system 1502, according to various aspects of the disclosure.

In some examples, the arm brace 100, as shown in FIG. 1, may be formed unitarily with the clamp mount system 1502. Although not necessary, the arm brace 100 may be comprised of two separate halves formed to engage with each other and with the receiver extension tube of the firearm. Further, the clamp mount system 1502 may not be configured to be inserted into the window171 but rather form a clamp mount portion of the arm brace 100, wherein each half of the clamp is configured to engage with the other half when the two halves of the arm brace 100 are engaged. In this way, the plurality of screw sets 1506 may be configured to affix a first half of the arm brace 100 to a second half of the arm brace 100 by engaging through-holes in the arm brace 100 and/or the clamp of the clamp mount portion. Mating the two halves of the arm brace may be effectuated by utilization of one or more screw sets 1506 and/or one or more fastening portions (e.g., snap engagement portions). Adjustment of the clamp may be effectuated by tightening or loosening of the plurality of screw sets 1506. The engagement means described above are not meant to be limiting and other engagement means are conceivable and applicable herein.

Figure 22:
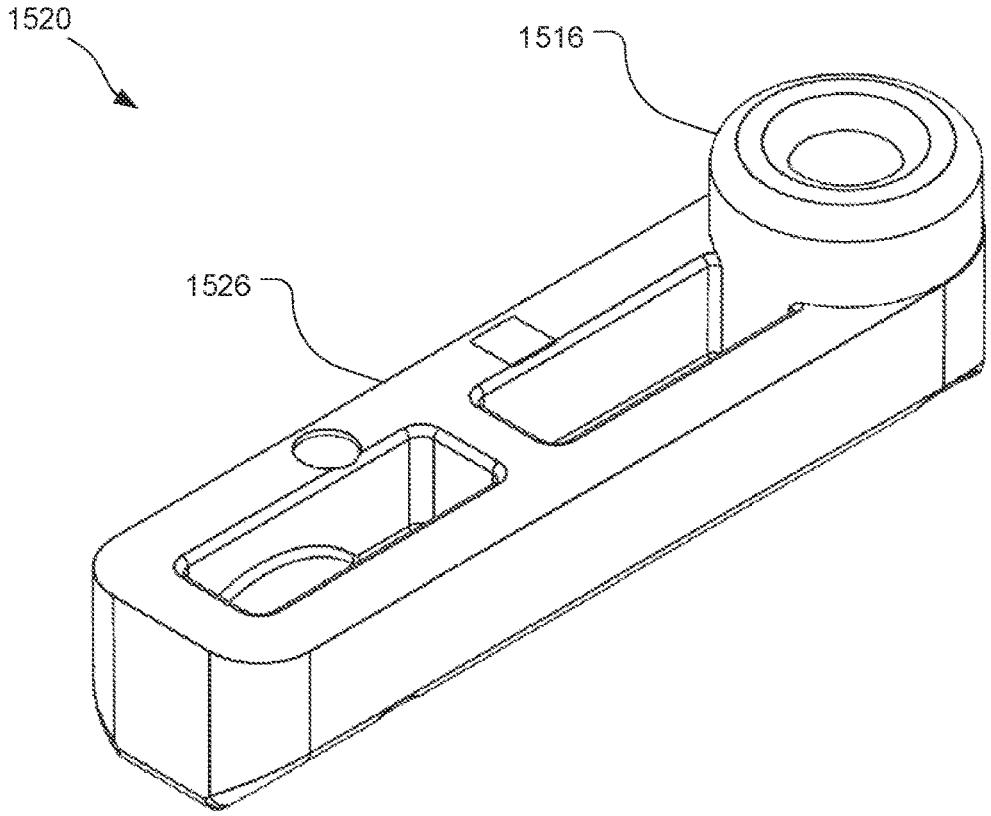
FIG. 22 depicts a top perspective view and left side elevation view of the insert of a clamp mount system according to an embodiment of present disclosure.
Figure 22:
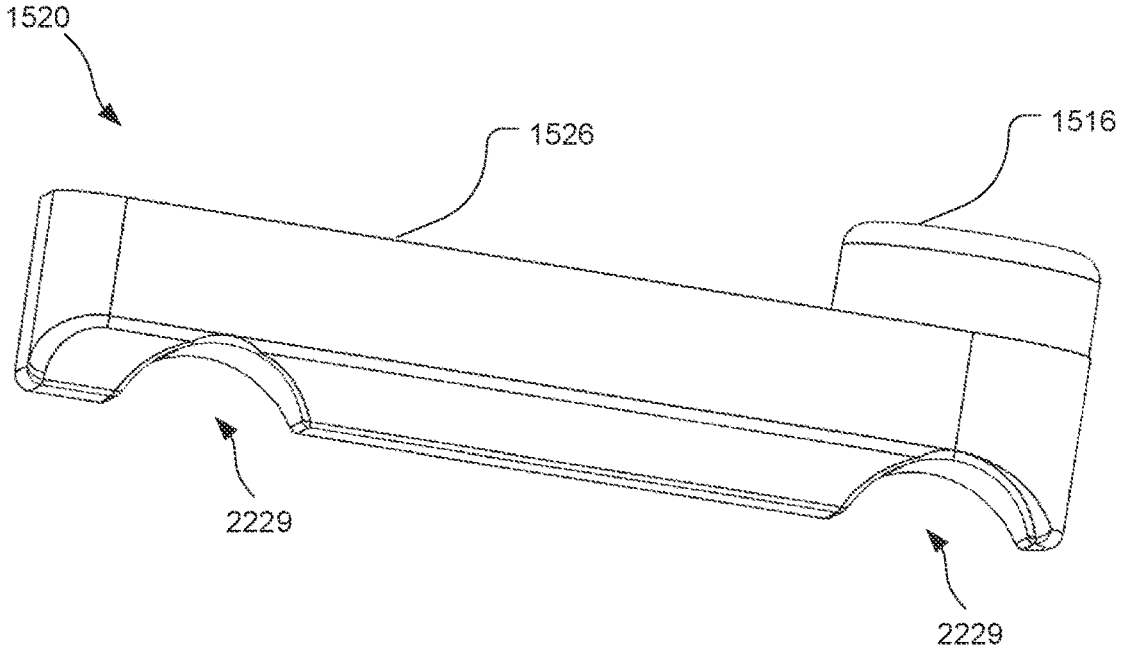

FIG. 22 depicts two alternate views, namely, a perspective view seen at the top of the page and a side view seen at the bottom of the page, of the insert 1520 of the clamp mount system 1502. As seen, the insert 1520 comprises a vertical section 1516 and a horizontal section 1526, where the vertical section 1516 is shaped and positioned near one end of the longitudinal section 1526. Although not necessary, in some embodiments, the vertical position 1516 may be located near a proximal (or rear) end of the insert 1520, which may allow the vertical section 1516 to be received within the rear-most tube locking hole of a keyed receiver extension tube, while also minimizing the distance between the vertical section 1516 and the proximal end of the arm brace. As seen in the side view, the insert 1520 includes one or more channels 2229 on its underside for the screws of the screw set(s) 1506. The channels 2229 may be shaped and sized to align with the through-holes on the sides of the clamps, which may enable the screws to pass underneath the insert 1520.

FIG. 23 illustrates an isolated view of the clamps 405 and 905 without the screw set(s) 1506, according to various aspects of the disclosure. As seen, the clamp 405 includes a plurality of through-holes 2338 shaped and sized to receive screws (e.g., male or female screws). Further, the clamp 405 includes a recess **2337-*a* for a pad (e.g., adhesive-backed rubber pad, such as pad 407 in FIG. 6). The clamp 405 further includes at least one boss 2336 on the interior side of the clamp, as described in relation to FIG. 3 above. Clamp 905 also includes a plurality of through-holes 2338 and at least one boss 2336 on the interior side of the clamp. In some cases, the bosses 2336 may be molded/formed around the through-holes of the clamps 405 and/or 905 and may serve to catch the protrusions (e.g., protrusions 351 in FIG. 3) of the clamp window (e.g., window 171 in FIG. 3) within the clamps. This interface between the clamp window and the clamp may help minimize medial (i.e., vertical) movement of the clamps, for instance, in the downward direction during installing. In some aspects, by preventing downward movement of the clamps, the bosses 2336** may also minimize shift (e.g., reduction) in the clamping force applied by the clamps on the buffer tube/receiver extension tube of the firearm.

Figure 24:
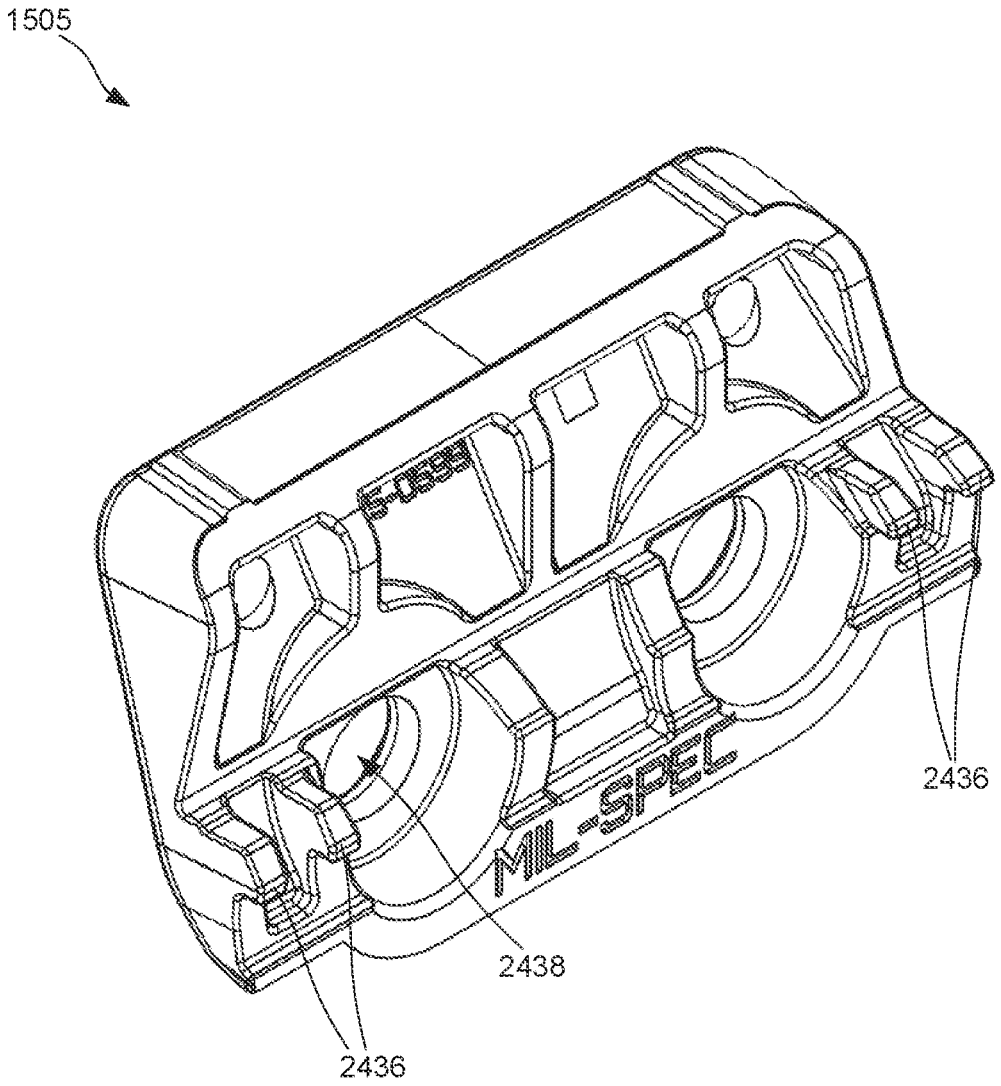
FIG. 24 illustrates a top perspective view of one half of the clamp of the clamp mount system according to an alternate embodiment of the present disclosure.

FIG. 24 illustrates an isolated view of the clamp 1505 without the screw set(s) 1506, according to various aspects of the disclosure. As seen, the clamp 1505 includes a through-hole 2438 and bosses 2436, which may be similar or substantially similar to the through-holes 2338 and bosses 2336 described in relation to FIG. 23.

Figure 29:
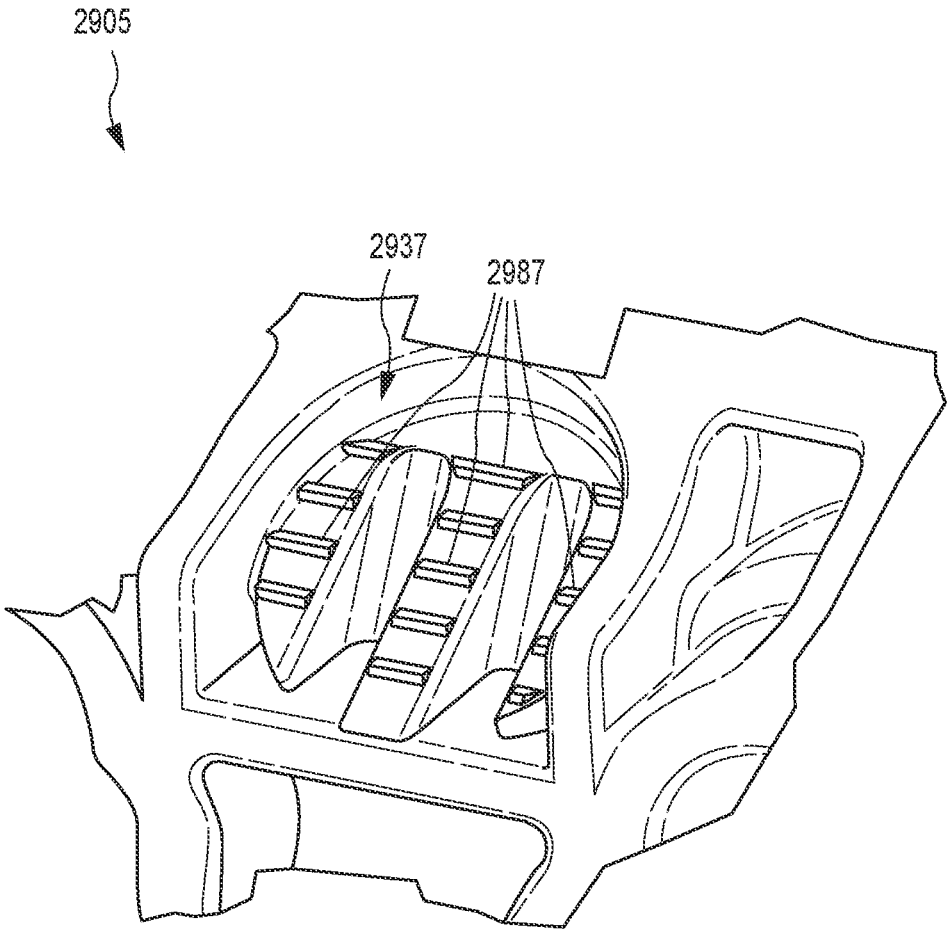
FIG. 29 illustrates an exploded view of a clamp according to an alternate embodiment of the present disclosure.

Turning now to FIG. 29, which illustrates a detailed view of a clamp 2905, according to an alternate embodiment of the disclosure. The clamp 2905 may be similar or substantially similar to one or more of the clamps 405 and/or 905, as described in relation to the figures above. In the example shown, the clamp 2905 includes a recess 2937 (e.g., also shown as recess 2337-*a*, recess 2337-*b* in FIG. 23) for a pad (e.g., adhesive-backed rubber pad, such as pad 407 in FIG. 6). The recess 2937 further comprises a plurality of serrations 2987 configured to engage or grip the bottom surface of the pad, which may not only help keep the rubber pad secured in place (e.g., prevent it from sliding down), but also minimize the likelihood of the arm brace (or stock) from moving (e.g., rotating) relative to the receiver extension tube. The serrations 2987 may be composed of the same material as the clamp 2905, for instance, polymer or a hard plastic. Alternatively, the serrations 2987 may be composed of a more rigid and/or gripping material (e.g., metal, metal alloy, or any other applicable material). In other embodiments, the pad may be integrated into a fastener or screw, such that additional customization of the gripping force of the clamp 2905 may be possible by adjustment of the fastener or screw. It should be understood that other structures that enhance coupling to the pad can be used in place of the illustrated serrations. For instance, the serrations 2987 may be replaced by textures, ridges, spikes, crisscross ridges, to name a few non-limiting examples.

Figure 25:
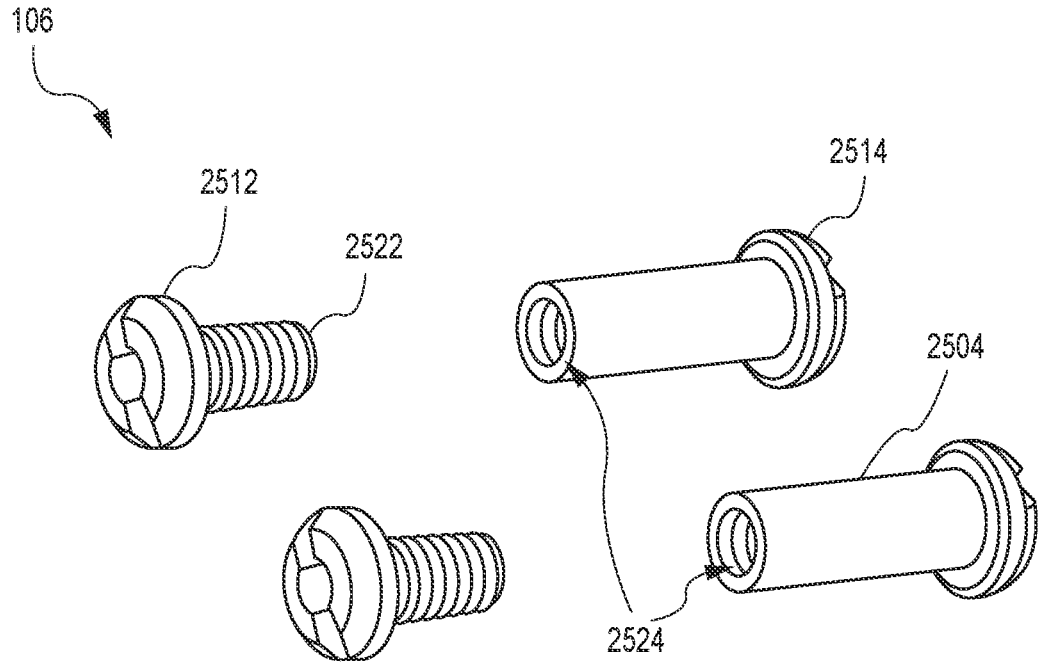
FIG. 25 illustrates top perspective view of exemplary fasteners according to an embodiment of the present disclosure.
Figure 25:
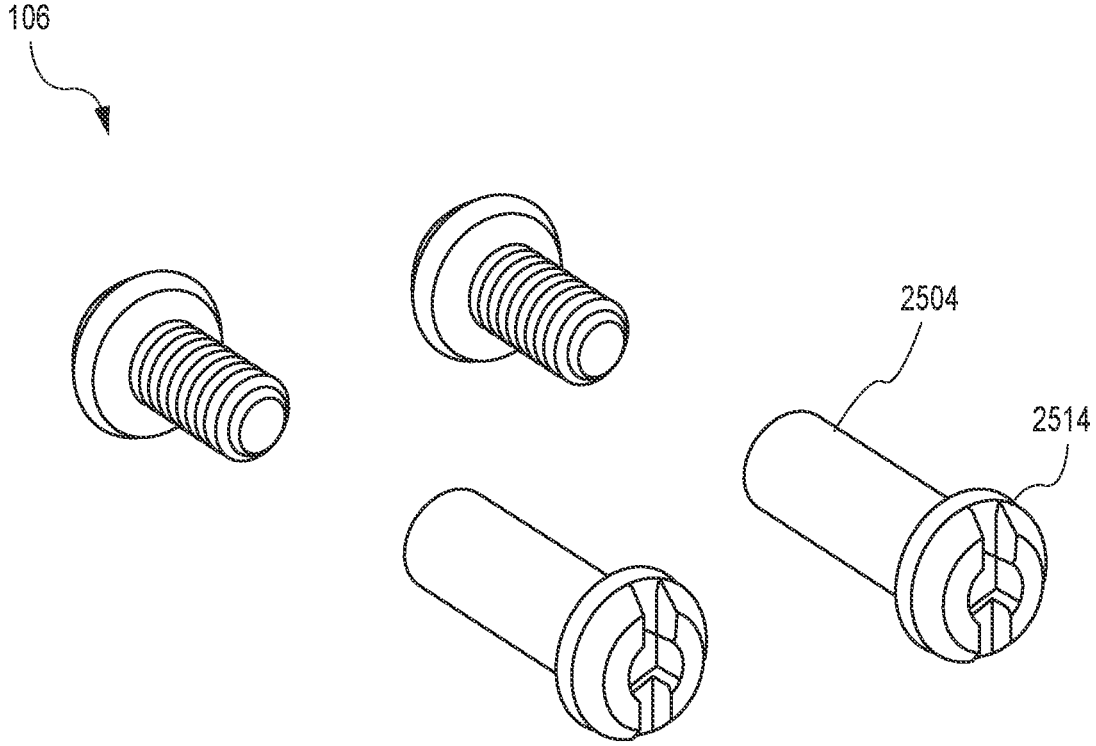

FIG. 25 illustrates two different views of screw set(s) 106, according to various aspects of the disclosure. In some cases, the screw set(s) 106 may be similar or substantially similar to the screw set(s) 406, 906, and/or 1506, previously described in relation to the figures above. As seen, each screw set 106 includes a male screw 2512 having a screw head and a threaded section 2522, and a female screw 2514 having a screw head and a threaded recess 2524. The male and female screws 2512 and 2514, respectively, may be shaped and sized to mate such that at least a portion of the threaded section 2522 is received within (and threads to) the threaded recess 2524. As noted above, the screw set(s) 106 may be utilized to vary the separation between the clamps of a clamp mount system, which may not only allow the clamp mount system to be utilized with different diameter receiver extension tubes, but also enable a snug/tight fit to the extension tube.

It should be noted that other fastening mechanisms besides male/female screws may be utilized in different embodiments, and the examples listed herein are not intended to be limiting.

Figure 26:
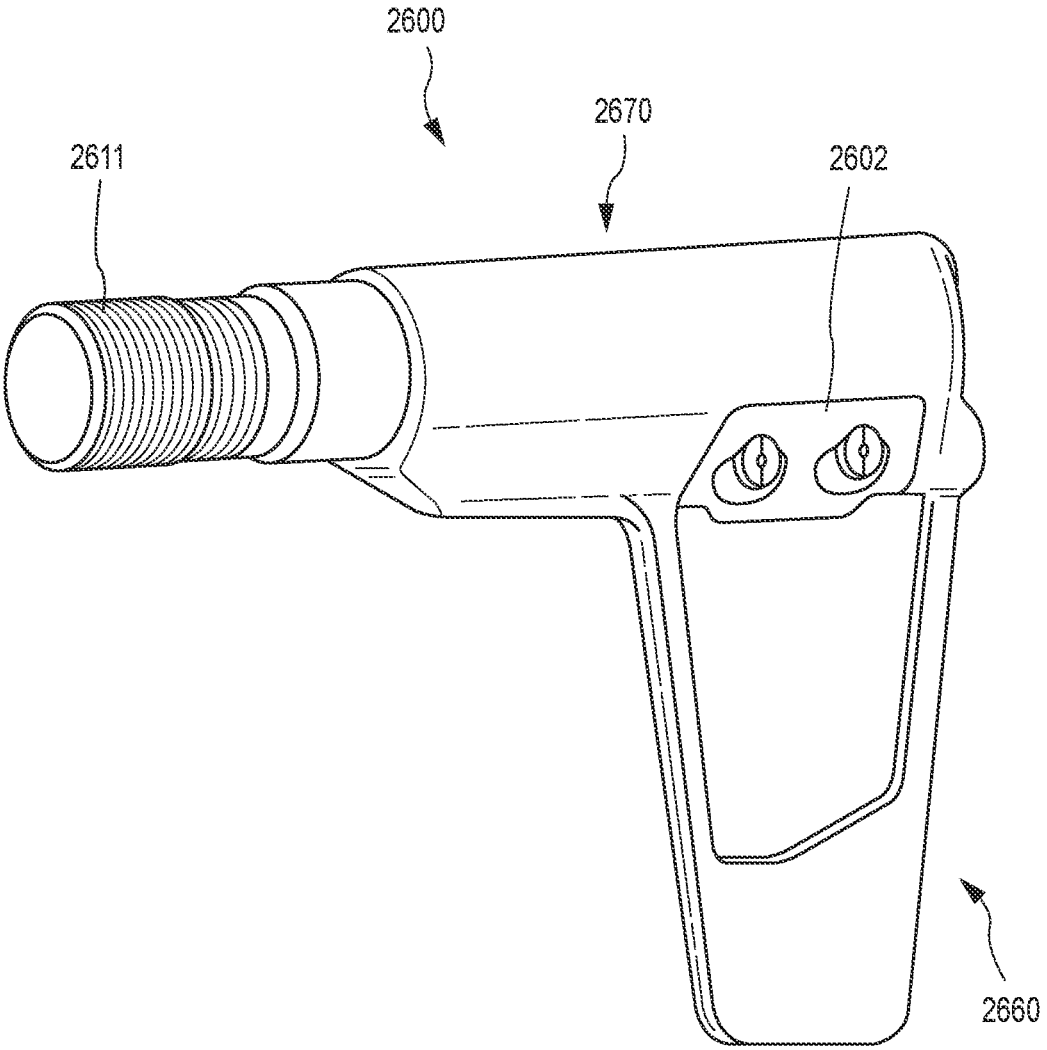
FIG. 26 illustrates a top perspective view of an arm brace coupled to a receiver extension tube of a firearm, according to an embodiment of the present disclosure.
Figure 27:
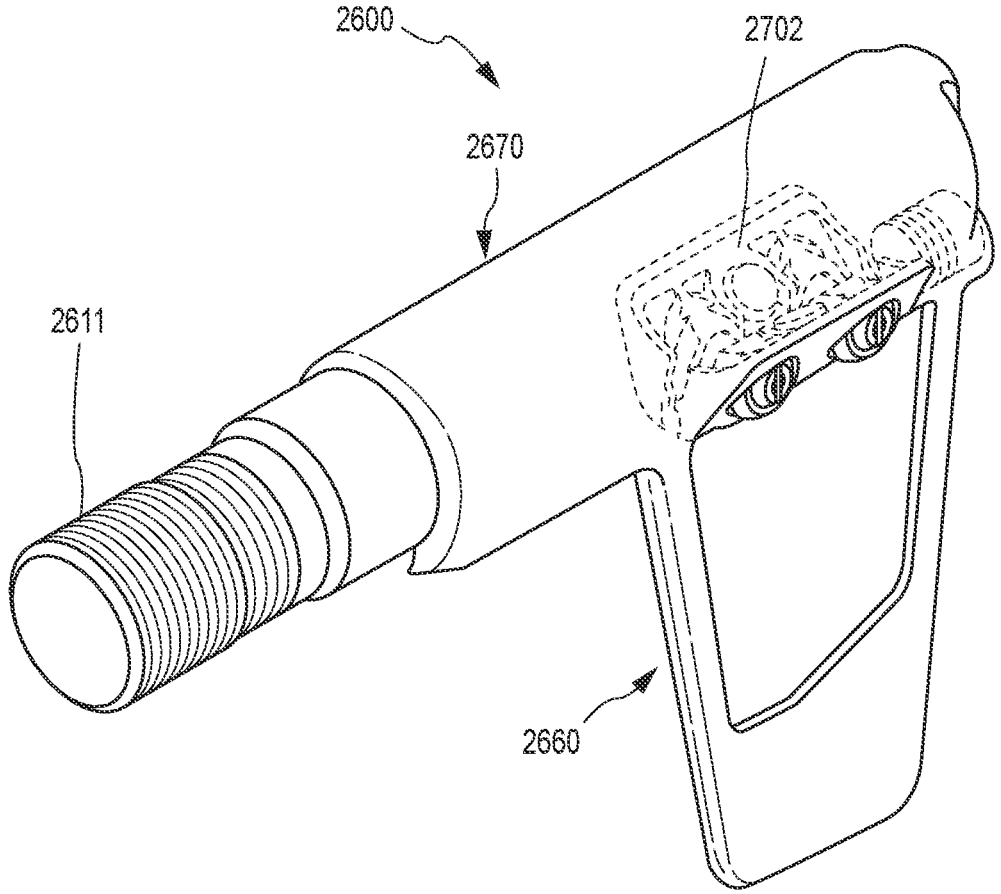
FIG. 27 illustrates a top perspective view of the arm brace of FIG. 26 coupled to the receiver extension tube of a firearm using a clamp mounting system adapted for use with keyless receiver extension tubes, according to an embodiment of the present disclosure.
Figure 28:
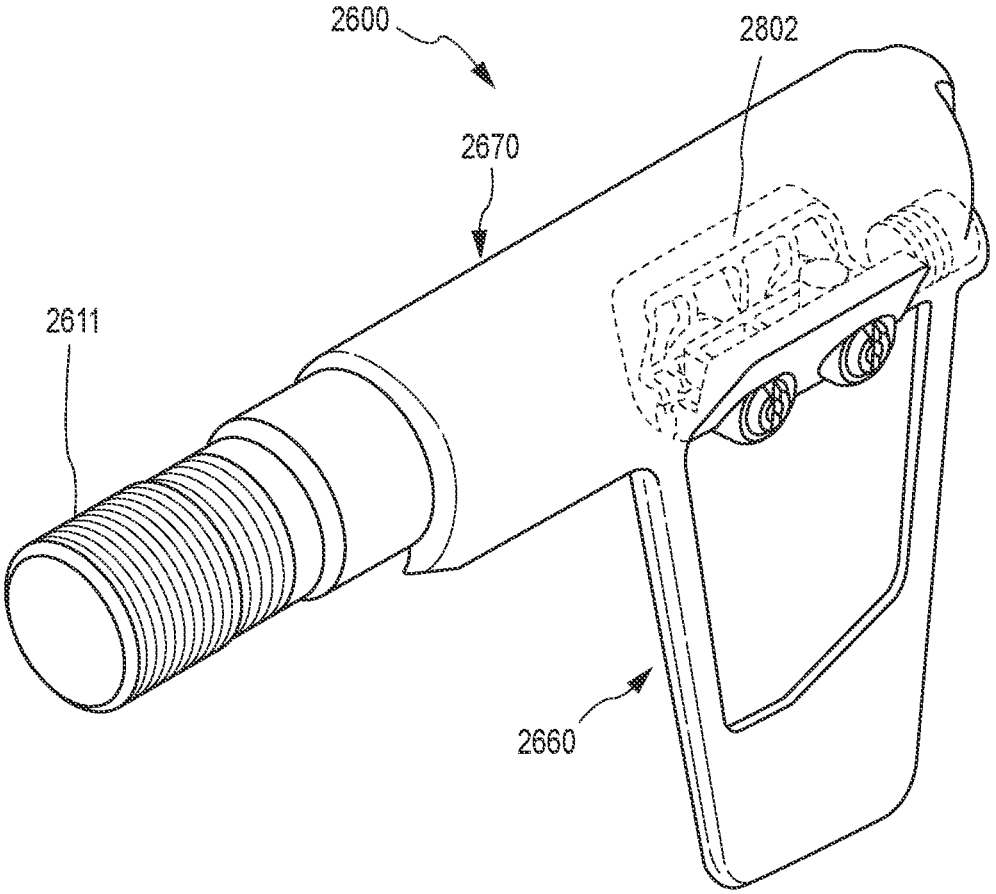
FIG. 28 illustrates a top perspective view of the arm brace of FIG. 26 coupled to the receiver extension tube of a firearm using a clamp mount system adapted for use with keyed receiver extension tubes, according to an embodiment of the present disclosure.

FIGS. 26-28 depict perspective views of an arm brace 2600 coupled to a receiver extension tube 2611, according to various aspects of the disclosure. The arm brace 2600 may be similar or substantially to the arm brace 100 described herein. As seen, the receiver extension tube 2611 may be received within a channel or opening (e.g., shown as opening 150 in FIG. 1) of an elongated body 2670 of the arm brace and secured in place (i.e., relative to the arm brace) using the clamp mount system 2602. The clamp mount system 2602 may be similar or substantially similar to any of the clamp mount systems described herein, including clamp mount system(s) 402, 902, and/or 1502. Further, the arm brace 2600 includes a rigid blade 2660 extending in a distal (or downward) direction from the elongated body 2670 of the arm brace. In some examples, the rigid blade 2660 and the elongated body 2670 may be unitary in construction.

FIG. 27 illustrates an example of the arm brace 2600 coupled to the receiver extension tube 2611 using a first type of clamp mounting system 2702, where the clamp mount system 2702 is adapted for use with keyless receiver extension tubes. The clamp mount system 2702 may be similar or substantially similar to one or more of the clamp mount system 402 and/or 902, described above.

FIG. 28 illustrates an example of the arm brace 2600 coupled to the receiver extension tube 2611 using a second type of clamp mount system 2902, for instance, a clamp mount system adapted for use with keyed receiver extension tubes. In this case, the receiver extension tube 2611 may be a keyed receiver extension tube having one or more tube positioning holes (or tube locking holes). In some examples, the clamp mount system 2902 may be similar or substantially similar to the clamp mount system 1502 described above.

FIGS. 30-37 depict various views of the arm brace 100, in accordance with one or more implementations.

Figure 30:
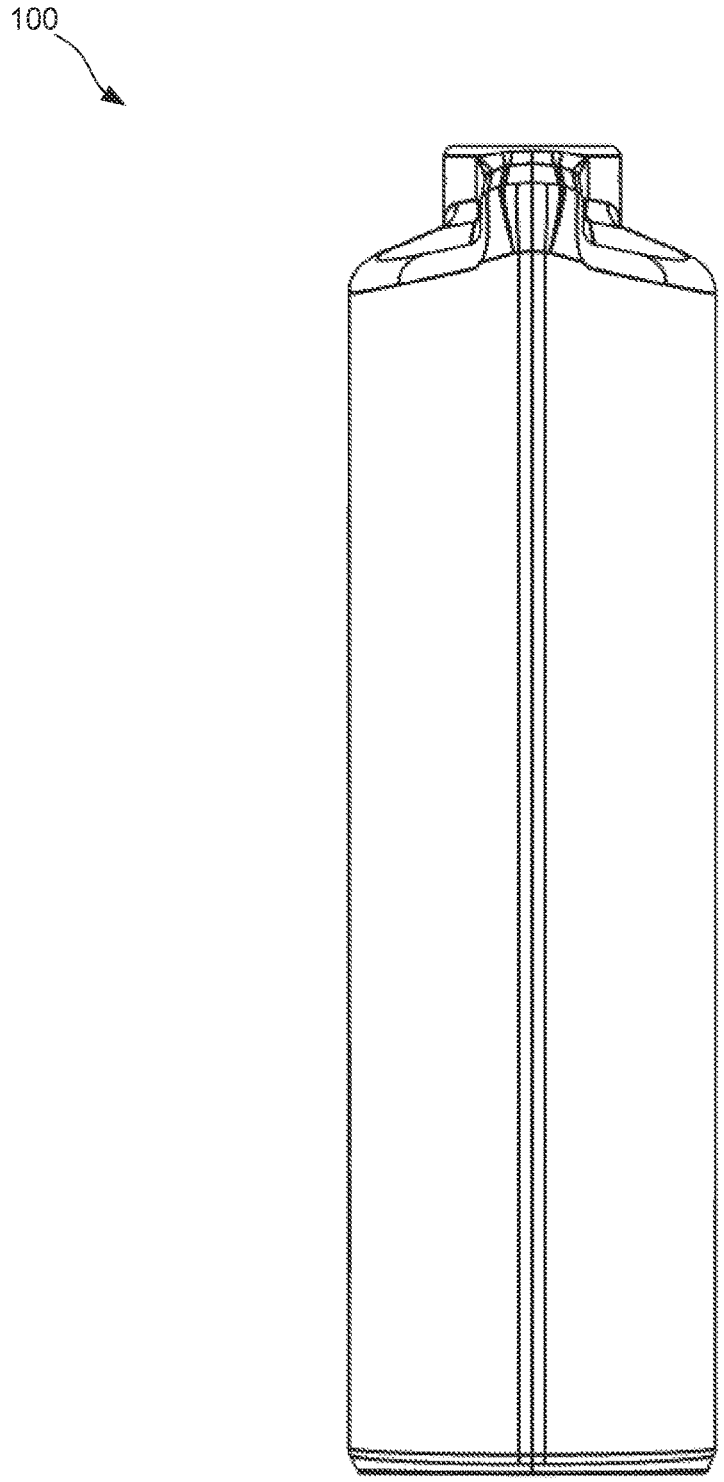
FIG. 30 illustrates a top view of the arm brace of FIG. 1.
Figure 31:
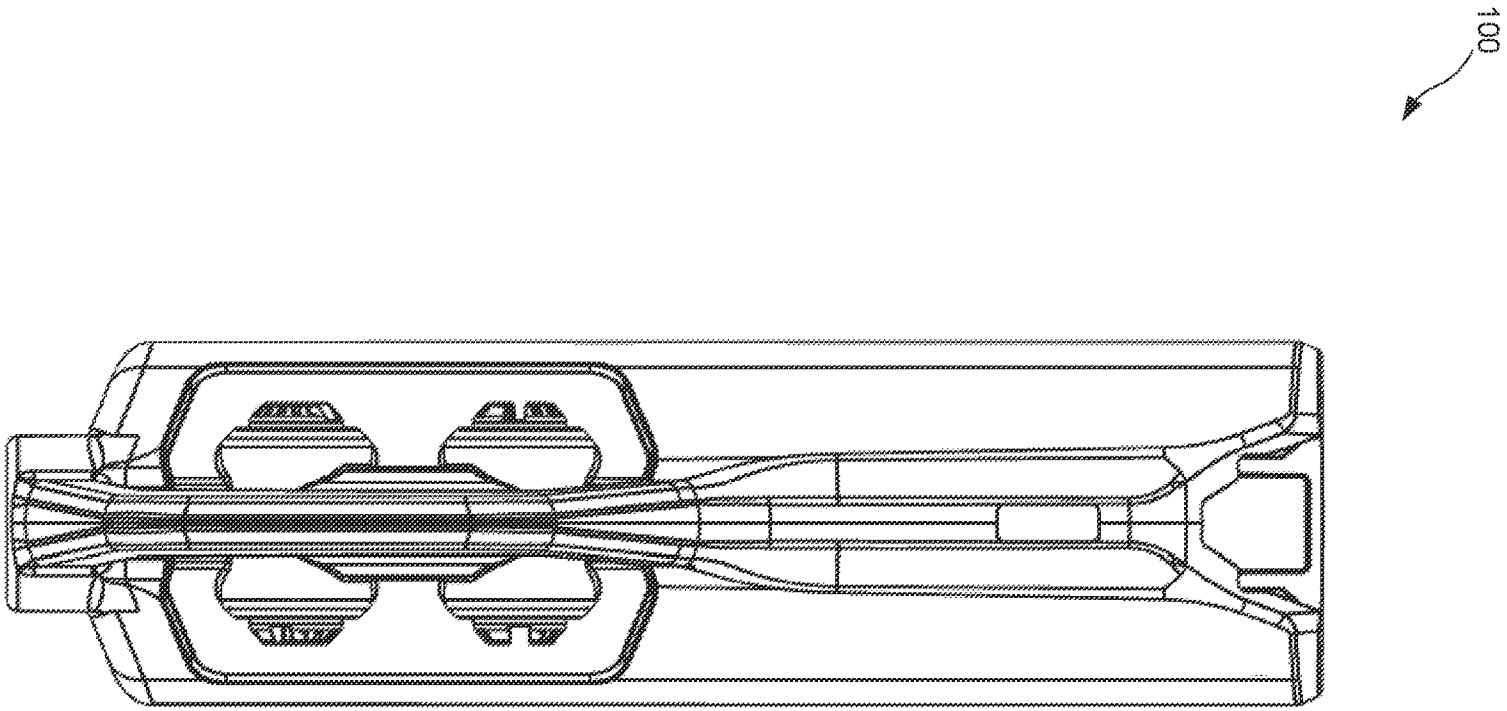
FIG. 31 illustrates a bottom view of the arm brace of FIG. 1.
Figure 32:
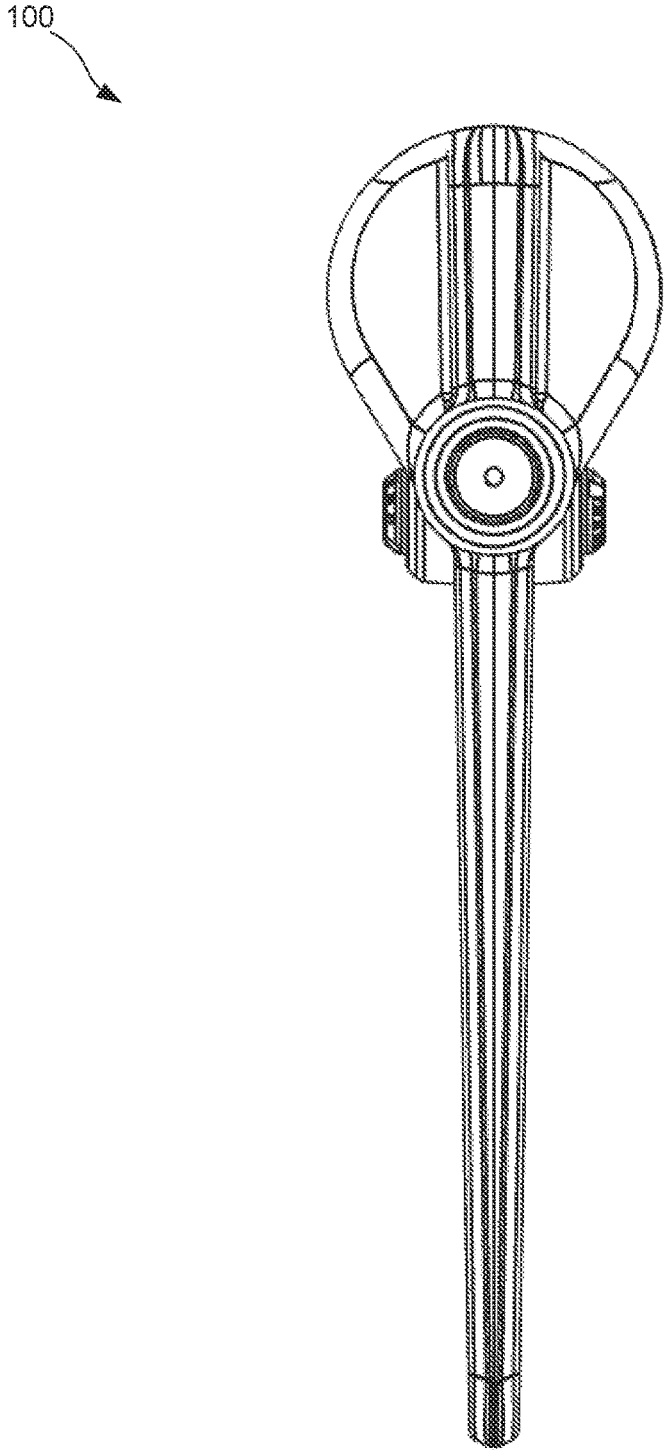
FIG. 32 illustrates a rear view of the arm brace of FIG. 1.
Figure 33:
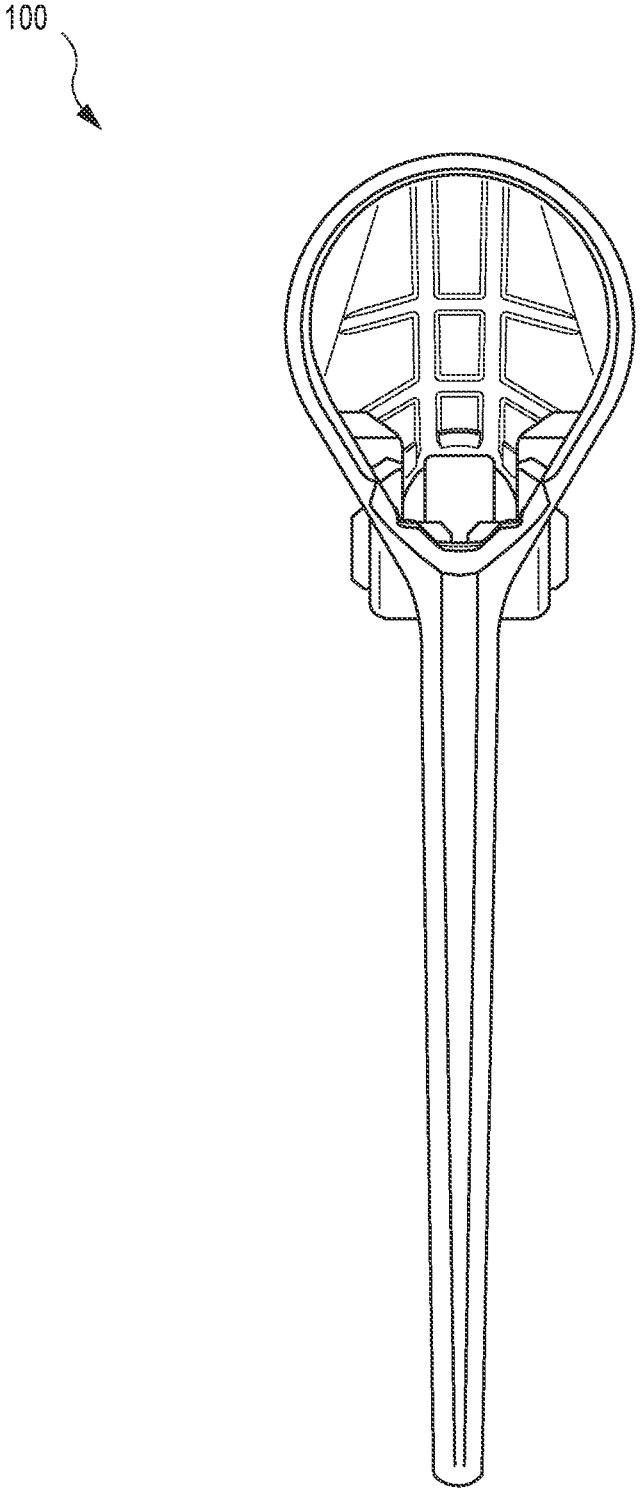
FIG. 33 illustrates a second front view of the arm brace of FIG. 1.
Figure 34:
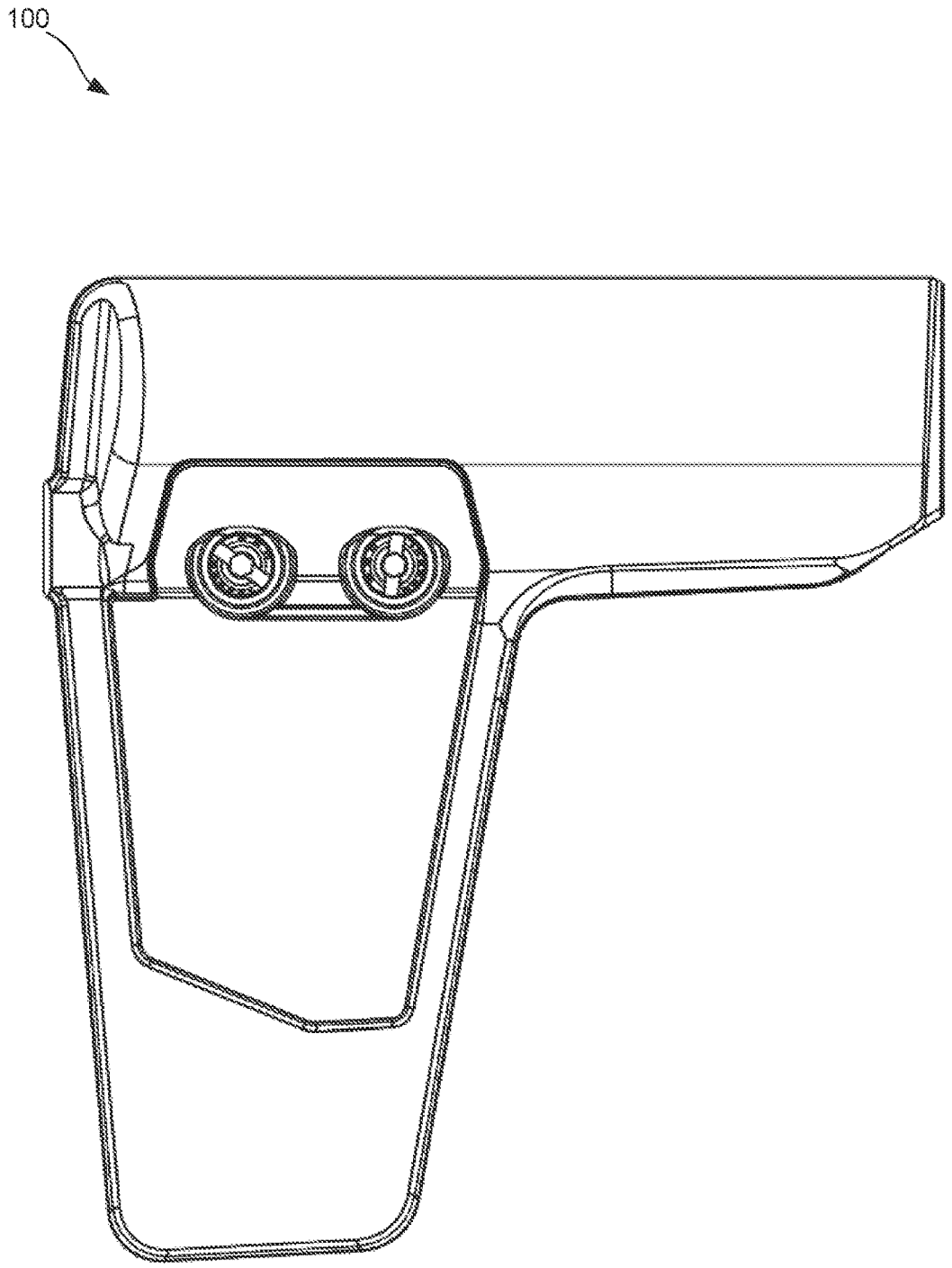
FIG. 34 illustrate a second right-side view of the arm brace of FIG. 1.
Figure 35:
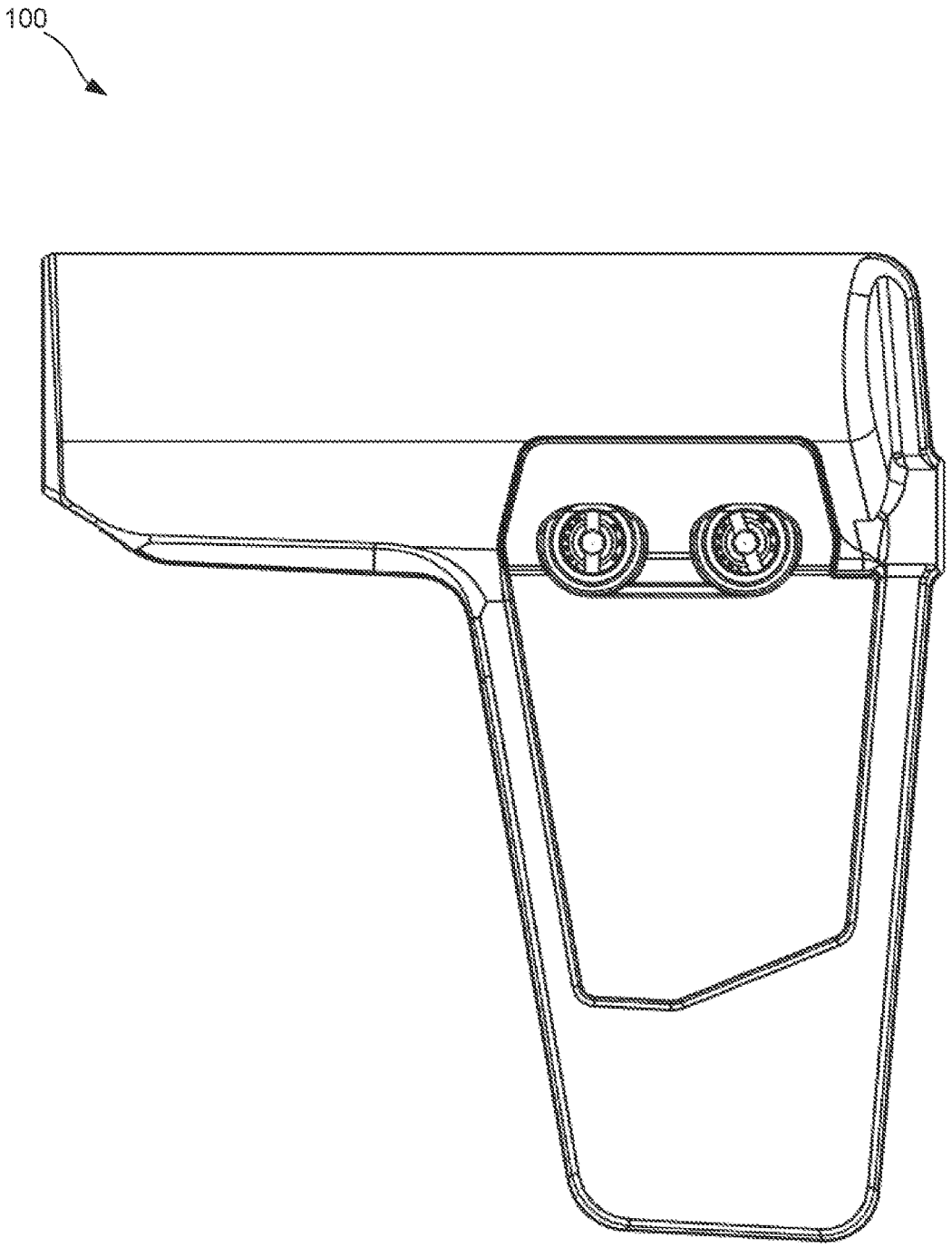
FIG. 35 illustrate a second left-side view of the arm brace of FIG. 1.
Figure 36:
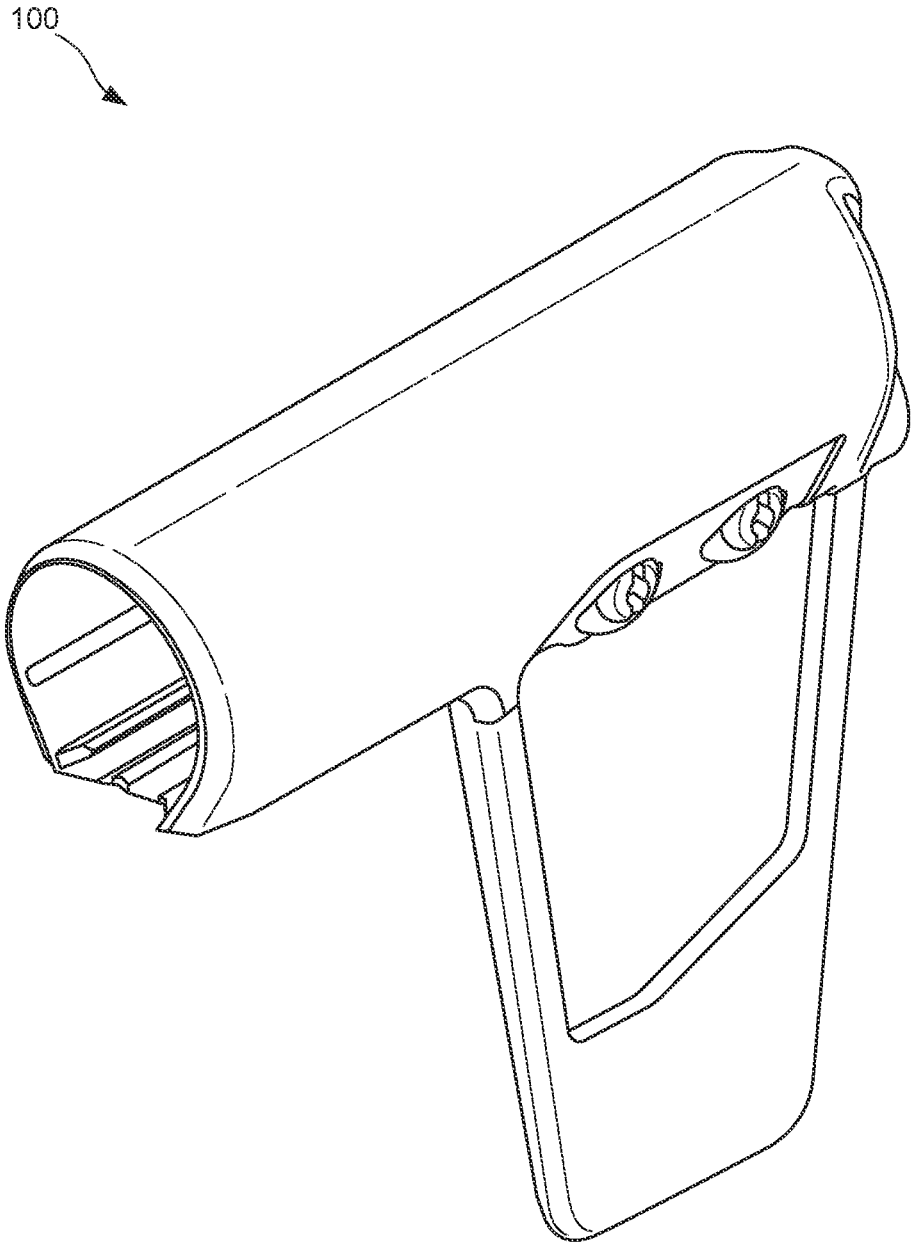
FIG. 36 illustrate a top, left isometric view of the arm brace of FIG. 1.
Figure 37:
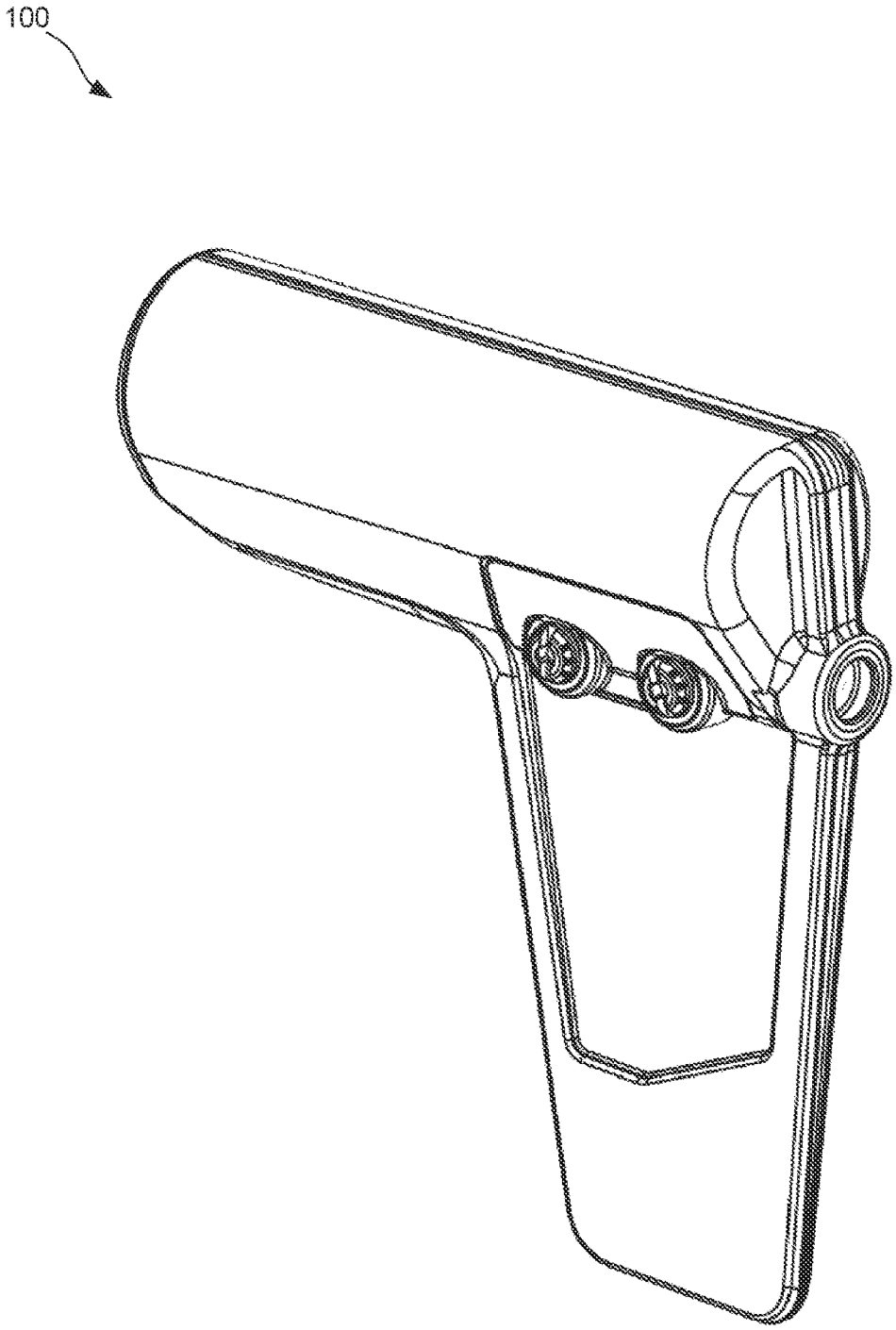
FIG. 37 illustrate a top, rear isometric view of the arm brace of FIG. 1.

As seen, FIG. 30 illustrates a top view of the arm brace 100, according to various aspects of the disclosure. FIG. 31 illustrates a bottom view of the arm brace 100, according to various aspects of the disclosure. FIG. 32 illustrates a rear view, and FIG. 33 illustrates a front view of the arm brace 100, according to various aspects of the disclosure. FIGS. 34 and 35 illustrate a right-side view and a left-side view, respectively, of the arm brace 100, in accordance with one or more implementations. FIGS. 36 and 37 illustrate two isometric views of the arm brace 100, according to various aspects of the disclosure. It should be noted that the illustrations depicted in FIGS. 30-37 are merely examples and are not intended to be limiting. In some instances, various design and/or aesthetic modifications to the arm brace 100 and/or its components (e.g., clamp mount system, optional sling mount) may be made without departing from the spirit or scope of the disclosure.

In some embodiments, the arm brace of the present disclosure may be designed to accommodate both keyed and keyless receiver extension tubes. Further, the position of the clamp mount system (e.g., clamp mount systems 402, 902, 1502, 2602, 2702, and/or 2902) at or near the proximal end of the arm brace (e.g., arm brace 100, 2600) may allow the arm brace to interact with the rear (or proximal) end of the extension tube that it is installed on. In this way, the arm brace may be installed all the way onto the extension tube until it bottoms out. Stability considerations aside (e.g., if the brace is not installed all the way over the tube, the clamps may not engage, and the brace may fall off the tube during use), such a design also serves to reduce the length of pull (LOP) dimension on the firearm to the shortest possible, which may help prevent the firearm from being classified as a Title II firearm. In some instances, a LOP dimension greater than 10.5 inches on a pistol may result in points being added to the firearm, pushing it into SBR territory under the revised ATF guidelines. Further, in some circumstances, adjustable arm braces are more likely to cause a firearm to be classified under the SBR category, since points may be added to the weapon due to the fact that it is adjustable. Additionally, or alternatively, length adjustment capability may also allow for an increased LOP dimension (e.g., >10.5 inches), which may add points to the weapon, or even make the firearm non-compliant under Title I of the NFA. Although not necessary, in some embodiments, the clamp mount system of the present disclosure may be intended or designed to be non-adjustable on both pistol (e.g., round or keyless receiver extension tubes) and Mil-Spec (e.g., keyed receiver extension tubes) tube styles.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A firearm arm brace, comprising:

an elongated body;

an opening extending into the elongated body, the opening configured to receive a receiver extension tube of a firearm;

a brace body affixed beneath the elongated body;

a clamp mount configured to retain the firearm arm brace in a fixed position on the receiver extension tube, the clamp mount comprising one or more clamps and at least one through-hole, wherein the clamp mount is configured to force the receiver extension tube in a radial direction relative to the opening and against a portion of an inner wall of the opening;

a window extending into the opening and configured to receive the clamp mount; and one or more pads located on the clamp mount, wherein the one or more pads are configured to engage with the receiver extension tube via adjustment of one or more fasteners interfacing with the at least one through-hole.

2. The firearm arm brace of claim 1, wherein the brace body comprises a blade extending distally relative to the elongated body.

3. The firearm arm brace of claim 1, wherein the brace body further comprises a sling mount positioned proximally relative to an end of the brace body and configured to engage with at least one of a Quick Detach (QD) sling swivel and a QD socket.

4. The firearm arm brace of claim 1, wherein the window comprises one or more protrusions configured to extend outward relative to the elongated body and shaped and sized to seat the one or more fasteners of the clamp mount.

5. The firearm arm brace of claim 4, wherein the clamp mount further comprises at least one boss configured to engage with an inner bottom portion of the window and interface with the one or more protrusions.

6. The firearm arm brace of claim 1, wherein the clamp mount is a pistol clamp system configured to engage with a cylindrical profile of a pistol or round receiver extension tube.

7. The firearm arm brace of claim 1, wherein the clamp mount is a keyed clamp mount and is configured to engage with a keyed profile of a keyed receiver extension tube.

8. The firearm arm brace of claim 7, wherein the clamp mount further comprises at least one insert shaped and sized to fit into a tube positioning hole of the receiver extension tube, wherein the at least one insert comprises:

a vertical section shaped and positioned near one end of a longitudinal section of the at least one insert, wherein the vertical section is configured to be received within a tube locking hole of the keyed profile of the keyed receiver extension tube; and one or more channels positioned on a horizontal section and configured to receive the one or more fasteners and align with the at least one through-hole of the one or more clamps.

9. The firearm arm brace of claim 1, wherein the one or more fasteners are male screws and screw posts, the screw posts comprising a threaded hollow post and configured to receive at least a portion of the male screws.

10. The firearm arm brace of claim 1, wherein the one or more clamps further comprises at least one recess configured to receive the one or more pads, wherein each recess of the at least one recess comprises a plurality of serrations configured to engage a bottom surface of the one or more pads.

11. A firearm arm brace, comprising:

an elongated body;

an opening extending into the elongated body, the opening configured to receive a receiver extension tube of a firearm;

a brace body affixed to at least a portion of the elongated body, the brace body having a first side and a second side;

a window extending through a portion of the elongated body and into the opening, the window comprising a window first side adjacent the first side of the brace body and a window second side adjacent the second side of the brace body; and a clamp mount received in the window and over a portion of the brace body, the clamp mount configured to contact the receiver extension tube when the receiver extension tube is received in the opening and to force the receiver extension tube in a radial direction relative to the opening and against a portion of an inner wall of the opening.

12. The firearm arm brace of claim 11, wherein the clamp mount comprises:

a first clamp at least partially received in the window first side; and a second clamp at least partially received in the window second side.

13. The firearm arm brace of claim 12, wherein the first clamp and the second clamp are configured to contact the receiver extension tube when the receiver extension tube is received in the opening.

14. The firearm arm brace of claim 12, wherein the first clamp and the second clamp are configured to contact the receiver extension tube as the first clamp and the second clamp are moved toward each other.

15. The firearm arm brace of claim 12, further comprising one or more first pads located on the first clamp and one or more second pads located on the second clamp, wherein the one or more first pads and the one or more second pads extend into the opening, and wherein the one or more first pads and the one or more second pads are configured to contact the receiver extension tube when the receiver extension tube is received in the opening.

16. The firearm arm brace of claim 12, further comprising one or more fasteners configured to fasten the first clamp and the second clamp together.

17. The firearm arm brace of claim 16, further comprising one or more protrusions extending outward relative to the elongated body and configured to seat the one or more fasteners.

18. The firearm arm brace of claim 11, further comprising one or more pads located on the clamp mount and extending into the opening, wherein the one or more pads are configured to contact the receiver extension tube when the receiver extension tube is received in the opening.

19. A firearm arm brace, comprising:

an elongated body;

an opening extending into the elongated body, the opening configured to receive a receiver extension tube of a firearm;

a brace body affixed to at least a portion of the elongated body, the brace body having a first side and a second side;

a window extending through a portion of the opening, the window comprising a window first side adjacent the first side of the brace body and a window second side adjacent the second side of the brace body;

a clamp mount received in the window and over a portion of the brace body, the clamp mount configured to retain the receiver extension tube in the opening when the receiver extension tube is received in the opening, wherein the clamp mount comprises a first clamp at least partially received in the window first side and a second clamp at least partially received in the window second side, and wherein the clamp mount is configured to force the receiver extension tube in a radial direction relative to the opening and against a portion of an inner wall of the opening; and one or more first pads located on the first clamp and one or more second pads located on the second clamp, wherein the one or more first pads and the one or more second pads extend into the opening, and wherein the one or more first pads and the one or more second pads are configured to contact the receiver extension tube when the receiver extension tube is received in the opening.

* * * * *